US005121777A

United States Patent [19]

Leininger et al.

[11] Patent Number: 5,121,777

[45] Date of Patent: Jun. 16, 1992

[54] VAPOR RECOVERY NOZZLES AND SUB-ASSEMBLIES THEREFOR

[75] Inventors: Donald L. Leininger; Robert W. Guertin; Bruce P. Baker, all of Cincinnati, Ohio

[73] Assignee: Dover Corporation, New York, N.Y.

[21] Appl. No.: 430,713

[22] Filed: Nov. 1, 1989

[51] Int. Cl.[5] ..... B65B 39/04

[52] U.S. Cl. ..... 141/207; 141/208; 141/217

[58] Field of Search ..... 141/206–215, 141/216–229, 392, 192, 198

[56] References Cited

U.S. PATENT DOCUMENTS

| | | | |
|---|---|---|---|
| 3,042,083 | 7/1962 | Kruckeberg | 141/215 X |
| 3,196,908 | 7/1965 | Billian | 141/209 |
| 3,710,831 | 1/1973 | Riegel | 141/207 |
| 3,771,577 | 11/1973 | Mayer | 141/209 |
| 3,982,571 | 9/1976 | Fenton et al. | 141/225 |
| 4,057,086 | 11/1977 | Healy | 141/206 |
| 4,141,393 | 2/1979 | Mayer | 141/206 |
| 4,143,689 | 3/1979 | Conley et al. | 141/207 |
| 4,213,488 | 7/1980 | Pyle | 141/208 X |
| 4,453,578 | 6/1984 | Wilder | 141/209 |
| 4,497,350 | 2/1985 | Guertin | 141/206 |
| 4,697,624 | 10/1987 | Bower et al. | 141/208 |

*Primary Examiner*—Ernest G. Cusick
*Assistant Examiner*—Casey Jacyna
*Attorney, Agent, or Firm*—Kinney & Schenk

[57] ABSTRACT

A vapor recovery nozzle, employed in minimizing atmospheric pollution by fuel vapors is described. The nozzle comprises a bellows which is compressed against the fill pipe of a vehicle fuel tank during discharge of fuel therein. The bellows surrounds a nozzle spout to define a vapor return flow path which extends through a nozzle body. The body of the nozzle is compositely formed by a body member and a vapor path cap which compositely define the vapor return flow passage. Flow of fuel is controlled by a control valve which may be opened, or maintained opened, by an operating lever only when a trip mechanism stem is latched in an operative position. A mechanical interlock prevents latching of the trip mechanism stem unless the bellows is compressed in sealing engagement with a fill pipe. When the bellows is so compressed, the trip stem is latched. If the level of fuel in the fill pipe covers the end of the spout, vacuum actuated means unlatch the trip mechanism stem. If the pressure in the vapor return flow path rises to a level indicating a blockage in return flow, the trip stem is also unlatched. A vapor valve is provided in the bellows to prevent the escape of fuel vapors when the nozzle is in a rest position. Angular relationships of the bellows and the spout facilitate obtaining a seal with a fill pipe. A groove is formed in the spout outwardly of and adjacent the vapor seal so that the vapor seal maintains its integrity in the event the spout is broken when inserted in a fill pipe. A trip mechanism sub-assembly, a spout sub-assembly and a bellows sub-assembly facilitate rebuilding, as well as the original assembly, of the nozzle.

19 Claims, 12 Drawing Sheets

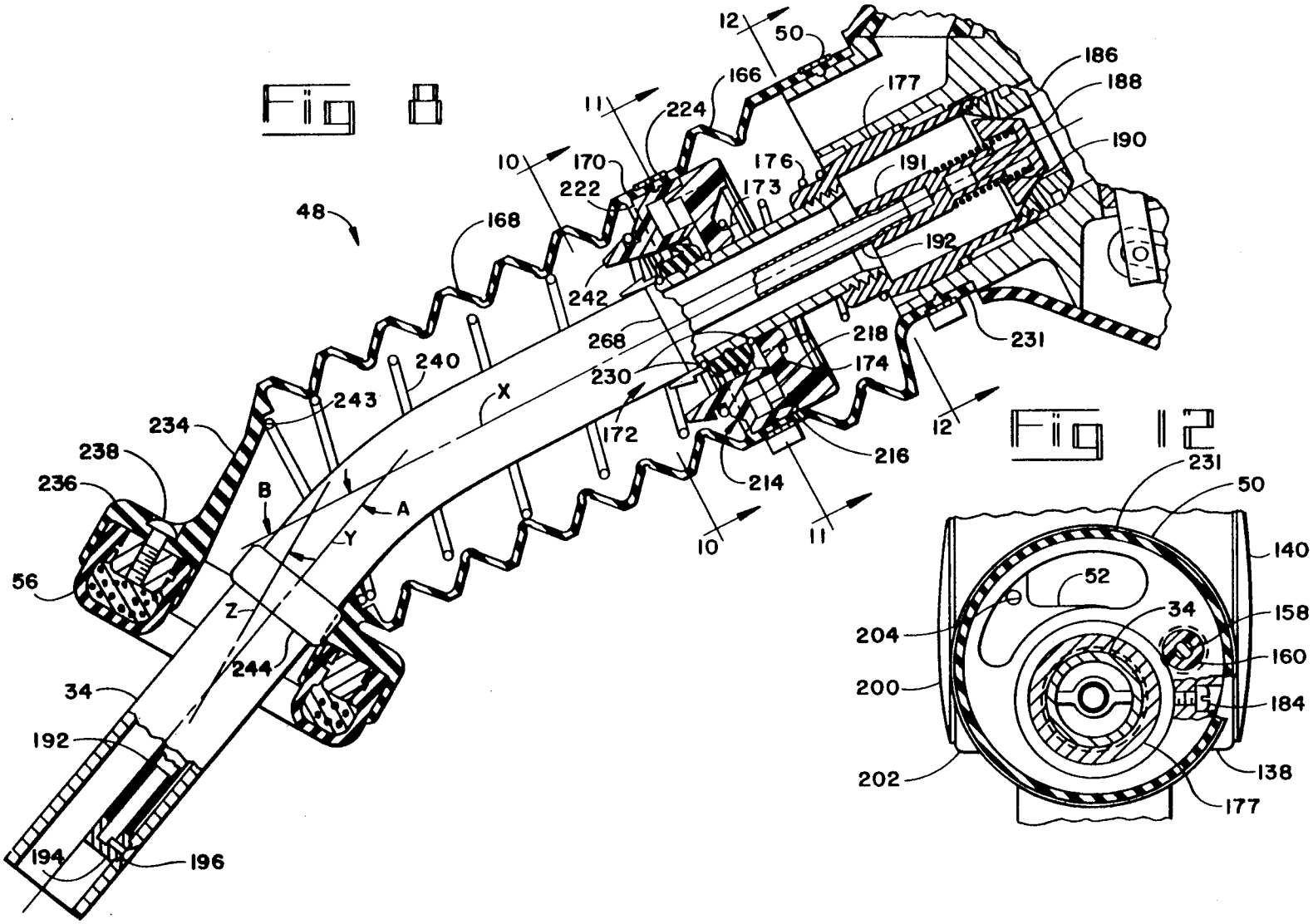
140
158
160
184
138
177
50
231
34
52
204
200
202
186
188
190
231
192
12
177
191
218
174
216
11
50
176
173
214
12
166
10
224
11
170
222
242
268
230
172
10
168
X
240
A
Y
243
48
B
Z
244
234
238
236
56
34
192
196
194

VAPOR RECOVERY NOZZLES AND SUB-ASSEMBLIES THEREFOR

The present invention relates to improvements in vapor recovery nozzles.

In the conventional delivery of gasoline, the spout of a nozzle is inserted into the fill pipe of a vehicle's fuel tank. As gasoline is discharged into the fuel tank, vapors are generated and displaced from the fuel tank. These vapors then freely pass into the atomosphere and become a significant source of pollution.

This source of pollution has been recognized for many years and several vaapor recovery proposals have been made which have the capability of reducing the escape of gasoline vapors to a minimal level. With the ever increasing concern over air pollution, governmental regulations are increasingly mandating the use of vapor recovery systems in delivering gasoline, and similar fuels, to vehicle fuel tanks.

A widely accepted vapor recovery system is based on returning fuel vapors to the storage tank from which the fuel is drawn. To attain this end, the nozzle is provided with a bellows which is compressed against the end of a fill pipe to effect a seal therewith. The bellows is usually coaxial of the nozzle spout and defines therewith a vapor return flow path which extends back to the fuel storage tank. Thus, fuel vapors, generated during delivery and displaced from the vehicle tank, flow through the fill pipe to the bellows and then back to storage tank. Nozzles employed in these systems are generally known as vapor recovery nozzles.

Several operating features are desirable, if not essential, for a commercially acceptable vapor recovery nozzle. These features include means for preventing delivery of fuel in the event that an effective seal is not obtained and maintained between the bellows and the fill pipe. Another of these features is to prevent continued delivery of fuel in the event that there is a blockage in the passageway which returns the fuel vapor to the storage tank. Another feature is to prevent the escape of fuel vapor the nozzle is not in use.

A further feature is the provision of means for shutting off delivery of fuel when it reaches a predetermined level in the fill pipe. This is a feature found in conventional nozzles which also has the characteristic of preventing contamination in that it prevents fuel from spilling to the ground.

Many proposed vapor recovery nozzles are found in the prior art. Some incorporate the several features noted above, and a limited number have found a measure of commercial acceptance.

However, the need for further improvements persists in several areas. There is a need to increase the ease of use of the nozzles, particularly in obtaining an effective seal between the bellows and a fuel tank fill pipe. Further, in facilitating ease of use, there is a need to reduce the bulk of vapor recovery nozzles so that may be handled with an ease approaching conventional nozzles.

Another area of shortcoming of conventional vapor recovery nozzles is found in their reliability and service life.

Yet another problem in existing vapor recovery nozzles is that fuel vapors escape into the atmosphere, in the event that a vehicle is driven away from a service station with the nozzle spout inserted into the fuel tank fill pipe. This is a rare event, for which conventional nozzles make provision by a planned failure mode in which the spout fractures from the nozzle body. However, this prior art teaching makes no provision for preventing the escape of fuel vapor when such an event occurs.

Still another shortcoming of present day vapor recovery nozzles is their expense and complexity.

This leads to a further factor in that it is an industry practice to rebuild fuel nozzles. This is to say that certain components of nozzles are subject to wear. Rather than discarding worn nozzles, the worn components are replaced in a rebuilding process wherein the worn components, or sub-assemblies are replaced.

A further and related factor is that it is desirable, particularly in vapor recovery nozzles to prevent unauthorized replacement of components. Thus, there is a need for preventing undetectable tampering with the internal components of a nozzle.

The general object of the present invention is to provide an improved vapor recovery nozzle.

A more specific object of the present invention is to improve the ease of use and reliability of vapor recovery nozzles.

Another object of the present invention is to provide a vapor recovery nozzle having an increased service life.

A further object of the present invention is to provide an improved, planned failure mode of a vapor recovery nozzle in the event that it is inserted into a fuel tank fill pipe of a vehicle which is driven away from a dispensing unit.

A further object of the present invention is to provide an improved valve for sealing the vapor return flow path when a vaopr recovery nozzle is not in use.

Yet another object of the present invention is to reduce the cost of vapor recovery nozzles, as well as their rebuilding, and in so doing to provide improved sub-assemblies therefor.

The foregoing ends are provided in a vapor receovery nozzle comprising a body having a fuel passage and a vapor passage. A spout, in flow communication with the fuel passage, projects from one end of the body. A bellows, in flow communication with the vapor passage, is mounted on the spout end of the body and defines a vapor flow path around the spout. The bellows is extended in a rest position of the nozzle, A normally closed control valve is interposed in the fuel passage. A trip stem is slidable to and from an operative position and lever means connected to the trip stem are effective to open the control valve, and maintain it open, only when the trip stem is latched in its operative position.

Means, engageable with the trip stem, are provided for latching it in its operative position. The latching means are disengaged from the trip stem in the position of the nozzle.

The nozzle has a delivery position in which the spout is inserted into a fuel tank fill pipe and the bellows is compressed and sealingly engages the outer end of the fill pipe.

In accordance with one aspect of the invention, interlock means, responsive to compression of the bellows, are provided to engage the latch means with the trip stem to thereby latch it in its operative position. The resilient means urge the latching means toward engagement with the trip stem. The interlock means include means for positively disengaging the latching means from the trip stem in the rest position of the nozzle.

In accordance with another aspect of the invention, vacuum actuated means, operative in the delivery position of the nozzle, are provided to disengage the latch means from the trip stem in response to the liquid in the fill pipe exceeding a given level.

Interlock means, responsive to compression of the bellows, engage the latch means, with the trip stem to latch it in its operative position. The latch means are connected to the vacuum actuated means, and the interlock means include means acting on the vacuum means to disengage the latch means in the rest position of the nozzle.

Several preferred features may be employed in accordance with the more limited aspects of the invention.

Thus the vacuum means may comprise a vacuum diaphragm, of circular outline, which, advantageously, may be disposed in a vertical plane outwardly spaced from the central, longitudinal plane of the nozzle body.

The trip stem may be generally vertically disposed in the central longitudinal plane of the nozzle body and have a notch, facing the vacuum diaphragm, for engagement by the latching means.

The latching means may comprise vertically spaced rollers mounted in a carrier, the latter being slidably mounted on a post projecting from the vacuum diaphragm.

The interlock means comprise a pin slidably mounted in the nozzle body and engagement with a pivotally mounted trip lever. A torsion spring may be employed to urge the trip lever to displace the vacuum diaphragm to a position in which the rollers are disengaged from the stem notch in the rest position of the nozzle. An actuating collar, mounted on the bellows engages the pin to displace the trip lever to a position permitting the latching rollers to engage the stem notch, when the bellows is compressed in the delivery position of the nozzle. A vapor valve may be mounted in the bellows and displace the actuator collar to so engage the interlock pin as the vapor valve is opened by compression of the bellows in the delivery position of the nozzle.

The nozzle body may have a lateral aperture in which the diaphragm, the outer end of the trip lever, the carrier and the rollers are disposed in series relationship. A cap may be threaded into the outer end of the aperture to define a vacuum chamber in combination with the outer surface of the vacuum diaphragm.

The trip lever may be mounted on a vertically disposed pin disposed to one side of the roller carrier and comprise an inner, bifurcated leg and an outer bifurcated leg through which the carrier post passes. The outer trip lever leg engages a rigid disc, mounted on the inner surface of the vacuum diaphragm, in displacing the rollers to a disengaged position in the rest position of the nozzle.

Means responsive to a predetermined pressure in the vapor passage (indicative of a blockage therein) may be provided to unlatch the trip stem in the delivery position of the nozzle. These means may comprise a pressure diaphragm disposed in the lateral aperture of the nozzle body. The pressure diaphragm may be disposed parallel to the vacuum diaphragm and spaced from the trip stem on the opposite side thereof. A pressure cap may be threaded into the aperture to define, in combination with the outer surface of the pressure diaphragm, a pressure chamber. A pusher member mounted on the inner surface of the pressure diaphragm, has legs engageable with the carrier for the rollers. Spring means permit the roller carrier to slide on the vacuum diaphragm post when it is displaced by the pressure diaphragm.

Preferably the trip lever, its pivot pin and torsion spring are mounted on a tubular insert which is insertable in the lateral aperture of the nozzle boby. This sub-assembly facilitates assembly of the nozzle as well as its rebuilding.

The ends of the present invention; in accordance with another aspect, may be attained by a vapor recovery nozzle comprising a body having a fuel passage and a vapor passage. A spout, in flow communication with the fuel passage, projects from one end of the body. A bellows, in flow communication with the vapor passage, is mounted on the one end of the body and defines a vapor flow path around the spout. The bellows is extended in a rest position of the nozzle. A normally closed control valve is interposed in the fuel passage. Means are provided for opening the control valve to discharge fuel from the spout. The nozzle has a delivery position in which the spout is inserted into a fuel tank fill pipe and the bellows is compressed and sealingly engages the outer end of the fill pipe.

A vapor valve, disposed within the bellows, controls flow of vapor within the bellows. The vapor valve is closed in the rest position of the nozzle and open when the bellows is compressed to its delivery position. The vapor valve comprises a first sealing member having a cylindrical surface and a second sealing member comprising a resilient annular lip engageable with the cylindrical surface. One of the sealing members is mounted on the bellows and the other sealing member is mounted on the spout, with the lip engaging the cylindrical surface in the rest position of the bellows. The cylindrical surface has a length such that the lip is axially spaced therefrom to an open position when the bellows is compressed in its delivery position.

In the preferred form, the bellows has a relatively short, inner convoluted section adjacent the nozzle body, an outer, relatively long convoluted section, and a non-convoluted section between the convoluted sections. The first vapor valve sealing member is mounted in the non-convoluted bellows section and the second vapor valve sealing member is mounted on the spout.

The first vapor valve sealing member may comprise an outer rim received in the non-convoluted section of the bellows, a radial web projecting inwardly from the outer rim, and a central hub connected to the inner portion of the web. The inner surface of the hub provides the cylindrical sealing surface. A band clamp clamps the non-convoluted bellows section against the outer rim.

The inner diameter of the convolutions of the inner convoluted bellows section at least approximates the outer diameter of the rim of the first vapor valve sealing member. A lip projects inwardly from the non-convoluted section of the bellows and is engaged by the side of the rim remote from the nozzle body to position the first vapor valve sealing member in the non-convoluted section of the bellows. The inner end of the bellow has a second non-convoluted section telescoped over and clamped to the adjacent, one end of the nozzle body.

The ends of another aspect of the invention may be attained by a vapor recovery nozzle comprising a body having a fuel passage and a vapor passage. A spout, in flow communication with the fuel passage, projects from one end of the body. A bellows, in flow communication with the vapor passage, is mounted on the one end of the body and defines a vapor flow path around the spout. The bellows is extended in a rest position of the nozzle. A normally closed control valve interposed in the fuel passage. Means are provided for opening the control valve to discharge fuel from the spout. The nozzle has a delivery position in which the spout is inserted into a fuel tank fill pipe and the bellows is compressed and sealingly engages the outer end of the fill pipe.

A vapor valve, disposed within the bellows, controls flow of vapor within the bellows. The vapor valve is closed in the rest position of the nozzle and open when the bellows is compressed to its delivery position. The spout has a weakened section adjacent to the vapor valve and disposed outwardly thereof, thereby providing a planned failure mode for the spout in which the vapor valve retains its integrity in the event the nozzle is subject to extreme forces.

Another aspect of the invention is found in a spout sub-assembly comprising a tubular adapter adapted to be received in a bore in a nozzle body and releasably secured therein. A spout extends from the adapter. A vapor valve member is mounted on the spout at a predetermined distance from the adapter. An interlock collar is slidably mounted on the spout between the seal member and the adapter. A compression spring is disposed between the adapter and the interlock collar.

Another aspect of the invention is found in a bellows sub-assembly comprising a bellows adapted to be mounted on a nozzle body generally concentrically, of the nozzle's spout, to define the outer bounds of a return vapor flow path in flow communication with a vapor passage in the nozzle body. The bellows comprises a first non-convoluted section adapted to be telescoped over the nozzle body at the spout end thereof, a relatively short, inner, convoluted section adjacent the nozzle body, an outer, relatively long convoluted section, and a second, non-convoluted section between the convoluted sections. A vapor valve member is mounted in the second non-convoluted bellows section.

In this sub-assembly, the vapor valve member may comprise an outer rim and an inner, cylindrical sealing surface. A band clamp may clamp the second non-convoluted section of the bellows against the outer rim of the valve member. The inner diameter of the of the inner convoluted section at least approximates the outer diameter of the vapor valve member ring. An annular seat is formed inside the outer end of the outer convoluted section. A compression spring is disposed between the annular seat and the vapor valve member.

Another aspect of the invention is found in a vapor recovery nozzle for delivery of fuel into a fuel tank fill pipe, wherein the nozzle comprises a body having a fuel passage and a vapor passage. A spout, in flow communication with the fuel passage, projects from one end of the body. The inner portion of the spout is concentric about a first axis. The outer portion of the spout is concentric about a second axis angled downwardly from the first axis. The portion of the spout intermediate its inner and outer portions is smoothly curved.

A bellows, in flow communication with the vapor passage, is mounted on the one end of the body and defines a vapor flow path around the spout, the bellows being extended in a rest position of the nozzle. The bellows has a face seal at its outer end which sealingly engages the outer end of a fill pipe when the spout is inserted a predetermined distance therein.

The bellows comprises an inner end portion disposed coaxially of the first spout axis. The inner end portion of the bellows comprises a convoluted section which is compressed to a delivery position when the spout is inserted in a fill pipe. The bellows further comprises a relatively short, outer, non-convoluted end portion which is formed coaxially about a third axis, angled downwardly from the first axis. The face seal is disposed on the outer end of the outer end portion of the bellows at right angles to the third axis. In the rest position of the spout, the inner end portion of the bellows extends outwardly of the intersection of the first and second axes a distance approximately half of the distance the inner end portion is compressed in its delivery position. The angle between the third axis and the first axis is greater than the angle between the second and first axes.

Another aspect of the invention is found in a vapor recovery nozzle comprising a body having a fuel passage and a vapor passage. A spout, in flow communication with the fuel passage, projects from one end of the body. A bellows, in flow communication with the vapor passage, is mounted on the one end of the body and defines a vapor flow path around the spout, the bellows being extended in a rest position of the nozzle. A normally closed control valve interposed in the fuel passage. A trip stem is slidable to and from an operative position. Lever means connected to the trip stem are effective to open the control valve, to maintain it open, only when the trip stem is latched in its operative position. Means, engageable with the trip stem, latch it in its operative position. The nozzle has a delivery position in which the spout is inserted into a fuel tank fill pipe and the bellows is compressed and sealingly engages the outer end of the fill pipe.

The nozzle body is compositely formed and comprises a main body member in which the fuel passage is formed and within which the control valve, trip stem, and latching means are mounted. A vapor passage cap extends along the upper surface of the main body member. The vapor passage is compositely formed in the main body member and the vapor passage cap.

Additionally, the trip stem may be adapted to be mounted in the main body member only through the top thereof. The control valve is, also, adapted to be mounted in the main body member only through the top thereof.

Further, the vacuum actuated means may include a vacuum diaphragm actuating the latching means. A lateral aperture may be formed in the main body member with the latching means and the vacuum diaphragm mounted therein. A cap may be threaded into the aperture to prevent access to the latching means and vacuum diaphragm after they are mounted in the aperture. The cap is provided with torquing means which are effective only in a direction threading the cap into the main body member.

Other aspects of the invention are found in various combinations of the referenced features.

The above and other related objects and features of the invention will be apparent from a reading of the following description of a preferred embodiment, with reference to the accompanying drawings, and the novelty thereof pointed out in the appended claims.

IN THE DRAWINGS:

FIG. 8 is a longitudinal section of the spout end portion of the present nozzle, on the enlarged scale of FIG. 3;

FIG. 9 is a longitudinal section of the spout end portion of the nozzle, similar to FIG. 8, showing the spout inserted into the fill pipe of a vehicle fuel tank;

FIG. 12 is a section taken on line 12—12 in FIG. 8.

FIG. 16 is a section, on an enlarged scale, taken on line 16—16 in FIG. 13, illustrating the trip mechanism and interlock positioned as they would before compression of the vapor recovery bellows;

FIG. 18 is a section taken on line 17—17 in FIG. 16, illustrating the trip mechanism and interlock positioned as they would be when the bellows in compressed for delivery of fuel;

FIG. 19 is a fragmentary section similar to FIG. 16 illustrating the trip mechanism in the position of fig. 18;

FIG. 23 is a fragmentary section similar to FIG. 16, illustrating a vacuum diaphragm in the position of FIG. 22.

GENERAL DESCRIPTION

Figures 1, 2:
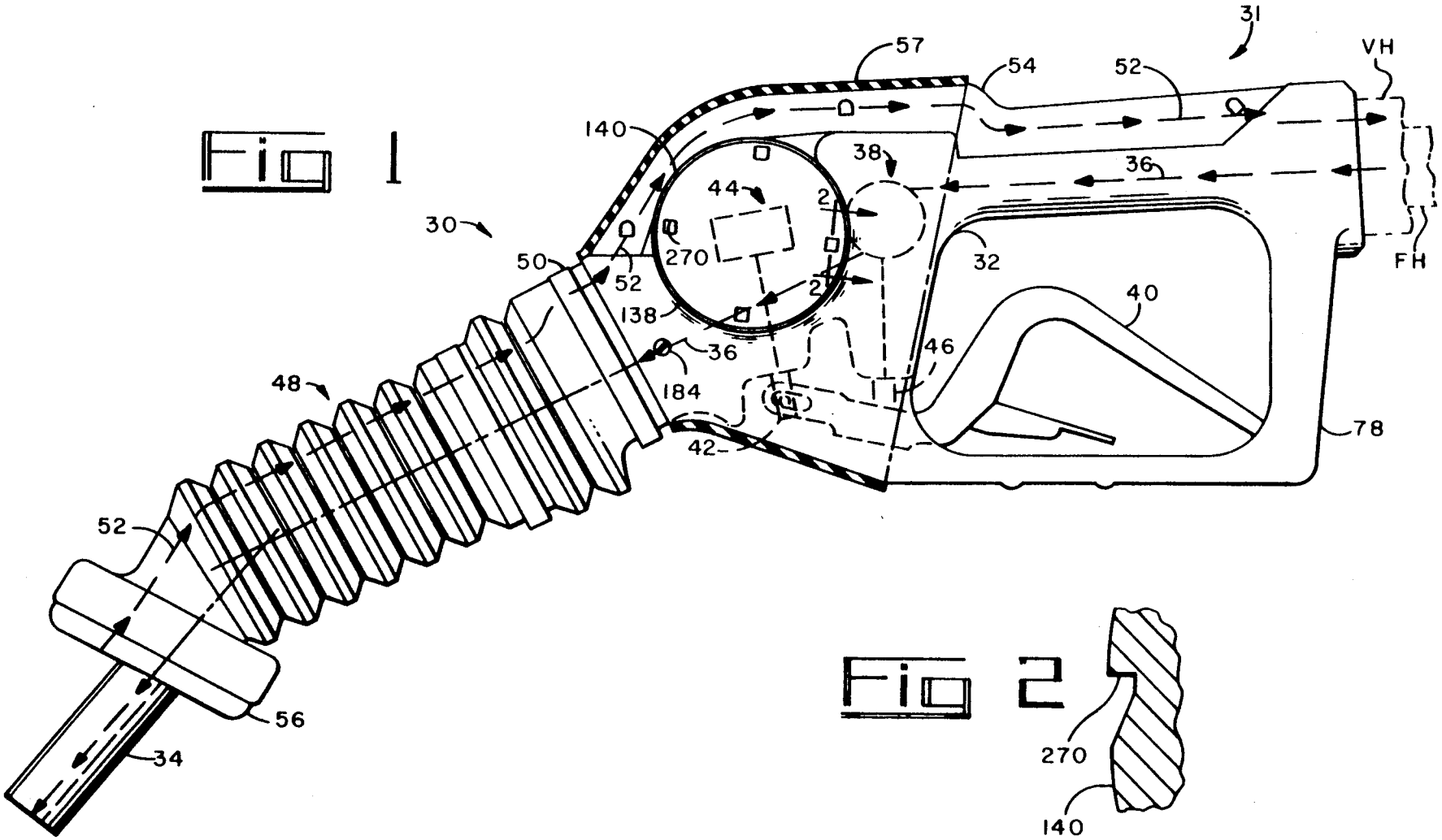
FIG. 1 is an elevation of a vapor recovery nozzle embodying the present invention.
FIG. 2 is a section, on an enlarged scale, taken on line 2—2 in FIG. 1.

Reference is first made to FIG. 1 for a description of a nozzle, indicated generally be reference character 30, embodying the present invention. The nozzle 30 is of the type commonly used in the retail sale of gasoline, and similar fuels, and finds particular utility in preventing fuel vapors from escaping into and contaminating the atmosphere. Such nozzles, known as vapor recovery nozzles, are incorporated in known systems for returning fuel vapors, generated in the delivery of fuel to a vehicle, to the storage tank of the retail station.

The nozzle 30 comprises a body 31 and a tubular discharge spout 34 mounted on one end of the body. The body 31, at its opposite end, is adapted for connection with a fuel hose FH which extends to a source of pressurized fuel. Fuel flows through a passage 36, in the body 31, to the discharge spout 34 when it is inserted into the fill pipe of a vehicle fuel tank.

Delivery of fuel from the nozzle 30 is controlled by a normally closed valve 38 which is interposed in the passage 36. The valve 38 is manually opened by a lever 40 which is pivotally mounted on a stem 42 which projects downwardly from a trip mechanism 44. When the stem 42 is latched in an upper position the lever 40 may be pivoted to raise a stem 46 and thereby open the fuel valve 38. When the trip mechanism unlatches the stem 42, it is displaceable downwardly to an inoperative position. When the trip stem 42 is unlatched, the lever 40 is inoperative to open the valve 38. If the valve 38 has been opened by the lever 40, unlatching of the stem 42, permitting it to be displaced to its lower position automatically results in closing of the valve 38 to prevent further delivery of fuel from the nozzle 30.

A bellows 48 is mounted on the body 31, by a clamp 50, in generally coaxial and spaced relation to the spout 34, thereby defining a vapor return passage 52 which extends from the bellows 48, to and through the body 31, to a hose VH secured thereto in coaxial spaced relation to the fuel hose FH. The hose VH is connected to means which return fuel vapors to the storage tank from which fuel is drawn for delivery by the nozzle 30.

At this point it will be noted that the body 31 is compositely formed by a main body member 32 and a vapor passage cap 54. The vapor return passage, through the nozzle 31, is compositely defined by portions of the main body member 32 and the vapor passage cap 54.

A face seal 56 is mounted on the outer, or free, end of the bellows 48. The seal 56 is adapted to engage the upper end of the fill pipe of a vehicle fuel tank when the spout is inserted therein for the delivery of fuel (see also FIG. 9). Thus vapors generated during delivery of fuel are captured in the vapor return passage 52 and returned to the fuel storage tank.

A Protective sheath 57 may be telescoped over the spout end of the body 31 to minimize possible damage to the nozzle or a vehicle in its use.

The operational features of the nozzle 30 will also be briefly described at this point.

Until the nozzle 30 is inserted into a fill pipe and the bellows 48 compressed to firmly engage the seal 56 therewith, the trip mechanism 44 is unlatched and lever 40 is inoperative to initiate delivery of fuel. When so inserted, the lever 40 may be raised to open the valve 38.

Once fuel delivery has commenced, there are three conditions under which the trip mechanism 44 will unlatch the stem 42 to shut off fuel flow by closing the valve 38.

The first condition is where the fuel in the fill pipe reaches a level covering the lower end of the spout 34. This feature causes the trip mechanism to function, thereby shutting off fuel flow and preventing fuel from escaping from the fill pipe and spilling on the ground.

The second condition is where the compression of the bellows 48 against the upper end of the fill pipe is lost, as reflected by an extension of the bellows. This prevents continued deliver of fuel under a condition in which vapors could escape into the atmosphere.

The third condition is where there is a pressure rise in the vapor return passage. Such a pressure rise generally indicates that the vapors are not being properly returned to the storage tank. Shutting off fuel flow under this condition assures that vapor will be properly recovered into the storage tank.

FUEL CONTROL VALVE

Figure 13:
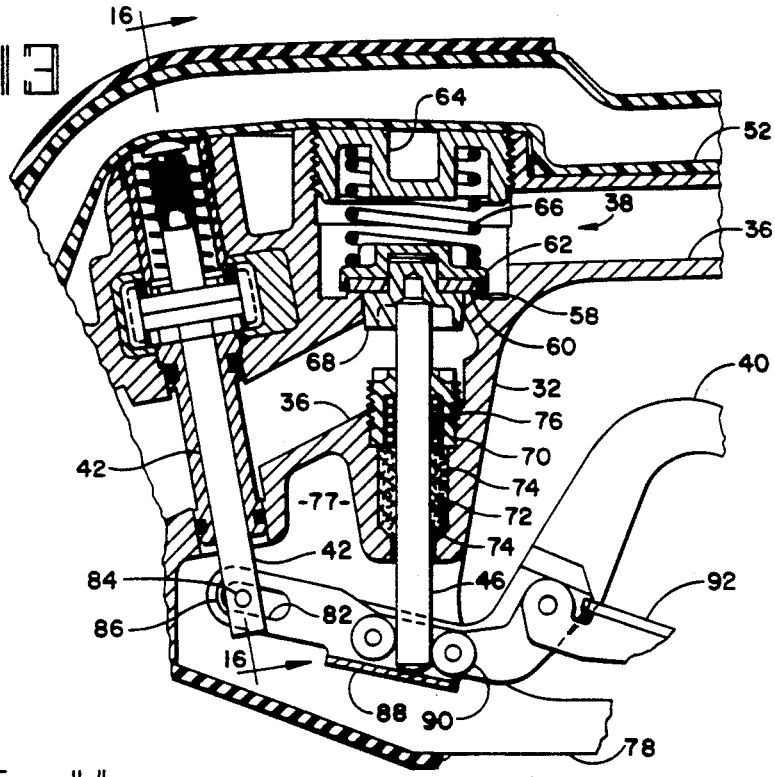
FIG. 13 is a fragmentary longitudinal section of the flow control valve portion of the present nozzle with the valve in its closed position.

Reference is next made to FIG. 13 for a description of the fuel control valve 38 which is mounted on a generally vertical axis within the body member 32. The valve 38 comprises an annular seat 58 and a disc 60. The disc is positioned in a disc holder 62. A cap 64, threaded into the body member 32, compresses a spring 66 against the holder 62 to normally maintain the disc 60 in sealing engagement with the seat 58. A tapered skirt 68, disposed beneath the disc 58, throttles fuel flow when the valve disc 60 is initially raised to an open position.

A packing retainer 70, threaded into the lower portion of the passage 36, beneath the valve 38, compresses a packing gland 72 between retainers 74, through a spring 76. The valve stem 46 is thus provided with a liquid seal as it extends from the valve 38, through the passage 36, to be engaged by the lever 40.

It is to be noted that the components of the valve 38 can be assembled, and removed only from the top of the body member 32, when the vapor passage cap 54 is removed. Likewise the valve stem and the packing components can be installed and removed only from the top of the body member 32. Further the diameters of the components progressively increase toward the top of the body member 32, facilitating machining of the threads for the retainer 70 and machining of the seat 58.

ACTUATION OF FUEL VALVE

Operation of the lever 40 to open valve 38 will next be described with reference to FIGS. 13–15. The lower ends of the trip stem 42 and the valve stem 46 and the inner end of the lever 40 are disposed in a recess 77 formed in the lower portion of the body member 32 to protect these components from abuse in use. Also, the body member 32 has an integral guard 78 which further protects the lever 40 from abuse.

In FIG. 13, the trip stem 42 is illustrated in its, upper, operative position. The lever 40 is compositely formed and includes a lower lever 80 which embrace the stem 42 (See also FIG. 16). Slots 82, formed in the lower lever 80 receive a pin 84 which extends through the trip stem 42. Wear washers 86 are disposed between the trip stem 42 and the lower lever 80 and have projections which enter the slots 82. The lever 40 is thus pivotally mounted on the trip stem 42 for relative sliding movement therebetween.

A bridge portion 88 of the lower lever 80 is engageable with the lower end of the valve stem 46. Rollers 90, between the plates 80 position the lever 40 relative to the valve stem 46, in a lengthwise sense.

Figure 14:
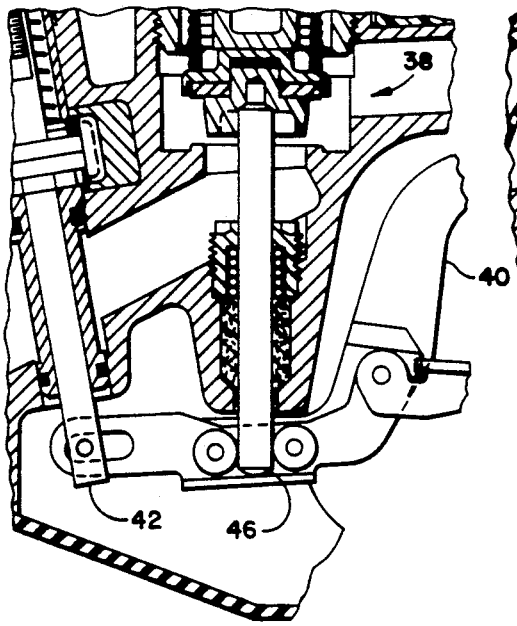
FIG. 14 is a section similar to FIG. 13 with the valve in its open position.

FIG. 14 illustrates the lever 40 in its raised position in which the valve 38 is opened for flow of fuel to the spout 34. In order for the valve 38 to be thus opened, the stem 42 must be latched in its upper, operative position by the trip mechanism. Latching of the stem in this position will be later described in detail. A latch 92, pivotally mounted on the lever 40, may be swung into engagement with the guard 78 to permit release of the lever 40 while maintaining the valve 38 open.

Open release of the latch 92, or release of the lever 40, valve spring 66 closes the valve 38 shutting off further delivery of fuel from the nozzle.

The valve 38 will also automatically close in response to the fuel in the fill pipe reaching a given level and in response to there being a pressure rise in the vapor passage 52 or in response to extension of the bellows 48 from its compressed condition, as indicated above. In each case, such end is attained by the trip mechanism unlatching the stem 42.

Figure 15:
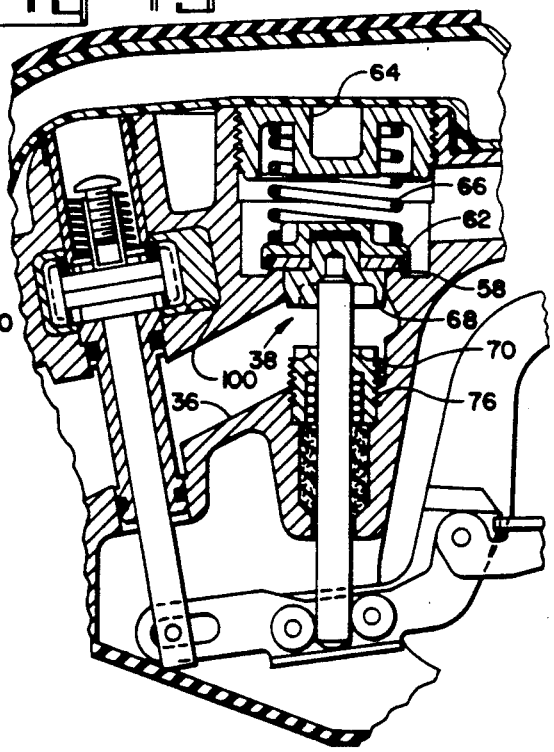
FIG. 15 is a section similar to FIG. 13 illustrating the manner in which trip mechanism of the present causes the control valve to close.
Figure 1B:
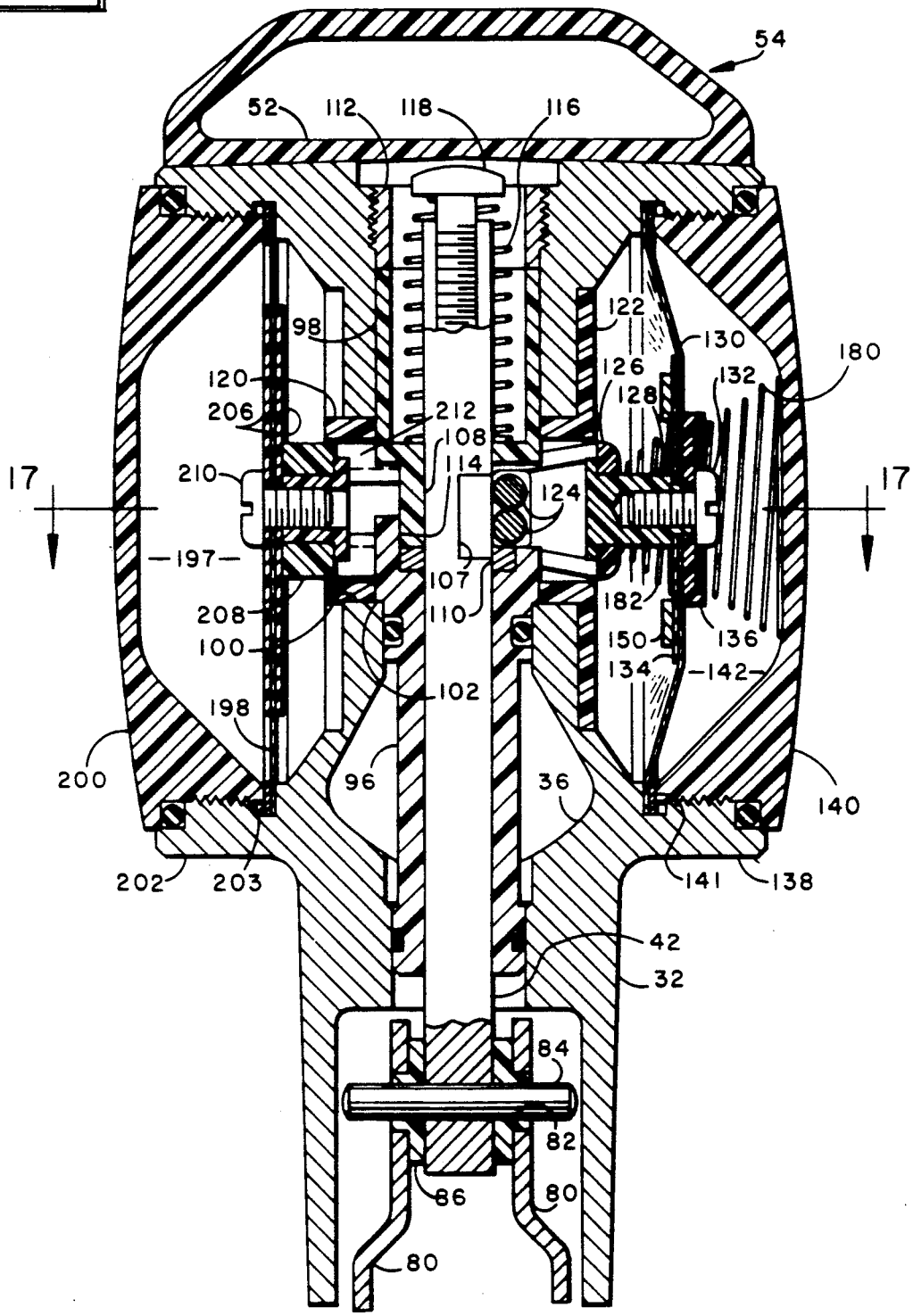

The force of the spring 66, transmitted to lever 40, is sufficient to displace the trip stem 42 downwardly to the inoperative position illustrated in FIG. 15, when the lever 40 is in a raised position, and in so doing to close the valve 38. Similarly, when the trip mechanism 44 unlatches, or releases, the stem 42, it is displaced downwardly as the lever 40 pivots about the relatively fixed valve stem 46, when the lever 40 is raised. As will later be more fully described, the trip stem is urged towards its upper, operative position by a spring (later described). That spring has substantially less force than the spring 66, so that the valve stem 46 is relatively fixed when the stem 42 is unlatched.

TRIP MECHANISM

The trip mechanism 44 will next be described, with reference first being made to FIGS. 16 and 17, which illustrates the trip mechanism in its rest position. The trip stem 42 preferably has a square cross section and is slidingly mounted in a guideway of corresponding cross section compositely formed in a lower guide member 96, and an upper guide member 98, both of which have a circuilar outline.

The lower guide member 96 is mounted in a bore in the body member 32 and spans the fuel passage 36. O-rings prevent leakage of fuel from the passage 36 along the bore in which the guide member 96 is mounted. The upper end of the guide member 96 extends through a lateral aperture 100 formed in the body member 32 as the central portion of a lateral passage therethrough. The aperture 100 has a rectangular, horizontal outline, the bottom surface of which is engaged by a shoulder 102 at the base of an increased diameter of the lower guide member 96 to vertically position the guide member 96.

The upper guide member 98 is mounted, coaxially of the lower guide member 96 in a bore in the body member 32. The lower end of the upper guide member 98 and the upper end of the lower guide member 96 are spaced apart and, registered with a notch 107 formed in the stem 42, when it is in its operative position. The upper guide member 98 has an arcuate extension 108 which clamps a hardened wear piece 110 into a circular recess formed in the upper end of the lower guide member 96, thereby vertically positioning the guide member 98. The upper guide member 98 is held in this position by a retainer nut 112 threaded into the body member 32 and engaging the upper end of the upper guide member 98.

The arcuate extension 108 is received by a corresponding upwardly extending extension 114 of the lower guide member 96 to reenforce the stem 42 against lateral forces.

The upper end of the upper guide member 98 is counter bored to form an internal shoulder against a spring 116. The upper end of the spring 116 engages the head of a screw 118 which is threaded into the upper end of the trip stem 42. The spring 116 yieldingly maintains the stem 42 in its upper operative position in the rest position of the nozzle 30, i.e., before insertion of the spout 34 into a fill pipe for delivery of fuel.

Figure 20:
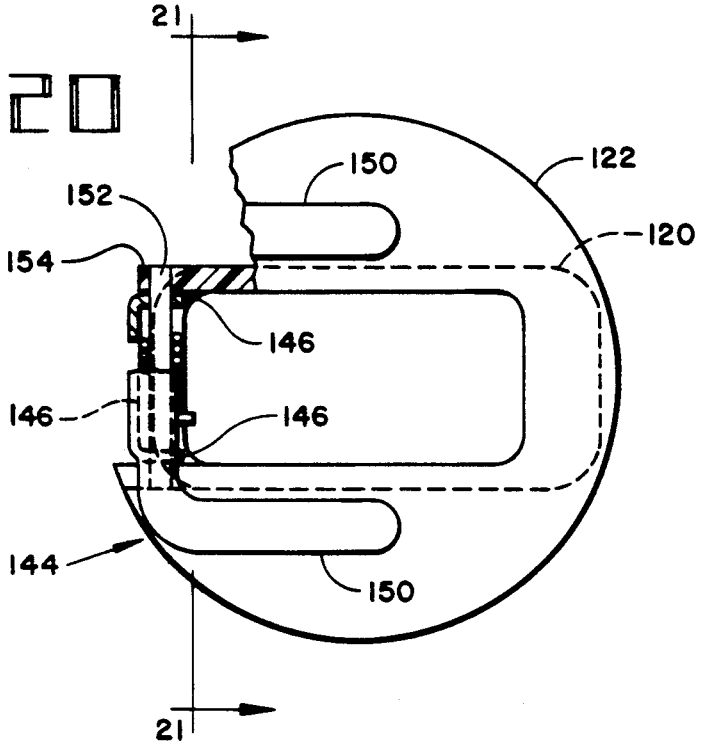
FIG. 20 is a section taken, on line 20—20 in FIG. 18, illustrating a trip lever sub-assembly.

It will be seen that an insert 120 is disposed in the aperture 100. The insert 120 is, in effect, a liner for the opening 100 and further provides mounting means for later described components. The insert has a circular flange 122 (see also FIG. 20) which is received in a counter bore formed in the body member 32. The upper and lower walls of the insert 120 having openings which permit assembly of the guide members 96, 98 after the insert is positioned in the lateral aperture 100.

It will be apparent that, upon removal of the vapor path cap 54, the described components of the trip mechanism 44 can be readily removed, through the top of body member 32, and replaced by unthreading the retainer 112 and the screw 118.

While the trip stem 42 is in its operative position in the described rest position, as previously indicated, the control valve 38 cannot be opened until the stem 42 is latched in this position. To this end, a pair of vertically aligned rollers 124 are provided. In the rest position of the nozzle, the rollers are spaced, at the open side of the notch 107, outside the vertical outline of the stem 42. The rollers are mounted in a carrier 126 disposed within the opening of the insert 120. The carrier is displaceable to dispose the rollers within the notch 107 to lock the stem 42 in its operative position.

The roller carrier 126 is slidably mounted on a headed post 128 which is secured to a vacuum diaphragm 130, formed of a resilient rubber-like material, by a screw 132. A relatively rigid disc 134, disposed on the inner surface of the diaphragm 130 is clamped against the post 128 by the screw 132. The screw 132 also clamps a cupped washer 136 against the outer surface of the diaphragm 130. The diaphragm 130 is disposed in a hollow, laterally projecting boss 138 formed on the body member 32 and secured therein by a cap 140. A friction ring 141 is disposed between the cap 140 and diaphragm 130 and functions as a lock washer to prevent unthreading of the cap 140. The cap 140, in combination with the outer surface of the diaphragm 130 forms a vacuum chamber 142, the function of which will be later described.

INTERLOCK

A mechanical interlock is provided to prevent the trip mechanism 44 from latching the stem 42 in its upper, operative position until and unless the bellows 48 is compressed to reflect that the seal 56 is in proper engagement with the upper end of a vehicle fill pipe.

Figure 21:
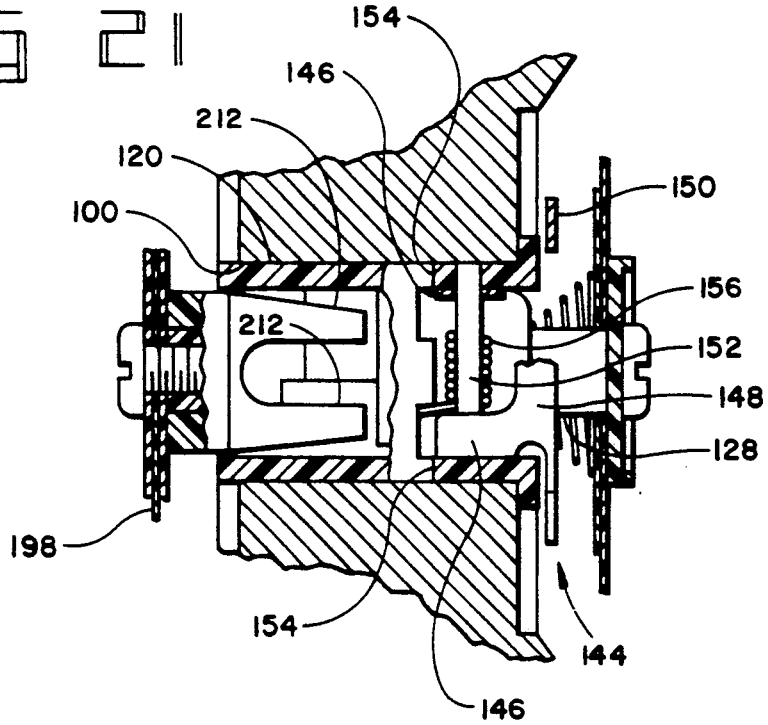
FIG. 21 is a section taken, on line 21—21 in FIG. 20, also showing mechanism associated with the trip lever sub-assembly.
Figure 21:
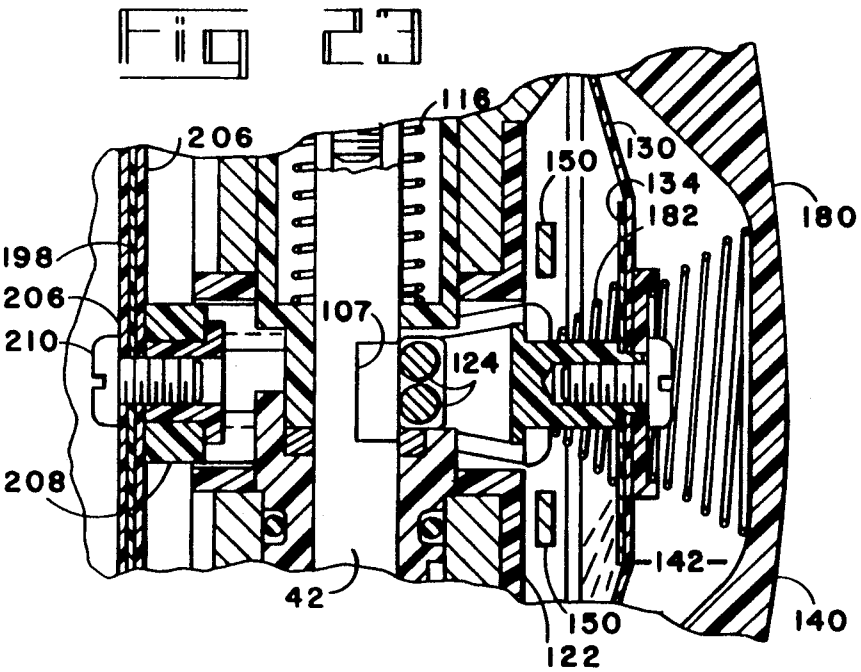

The interlock comprises a trip lever 144 (FIGS. 17, 20 and 21) pivotally mounted on the insert 120. More particularly, the lever 144 comprises a pair of vertically spaced legs 146 extending inwardly from a bridge 148. A second pair of vertically spaced actuator legs 150 (comprising a bifurcated outer end of the trip lever 144) extend from the bridge in generally parallel relation to the diaphragm 130. The legs 146 are pivotally mounted on a pin 152 which extends between tabs 154 which project from the upper and lower walls of the insert 120.

Figure 17:
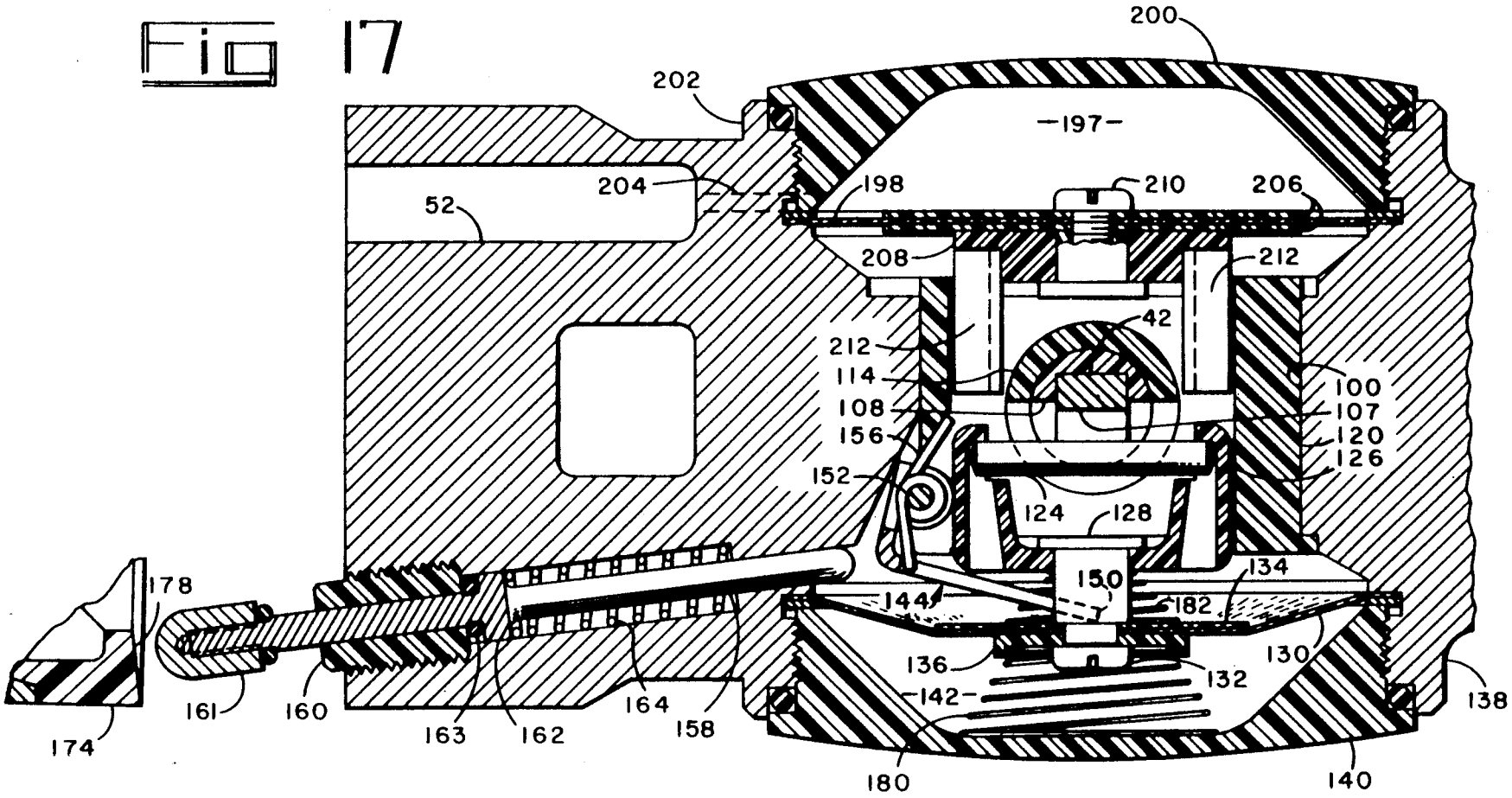
FIG. 17 is a section taken on line 17—17 in FIG. 16.
Figures 10, 11:
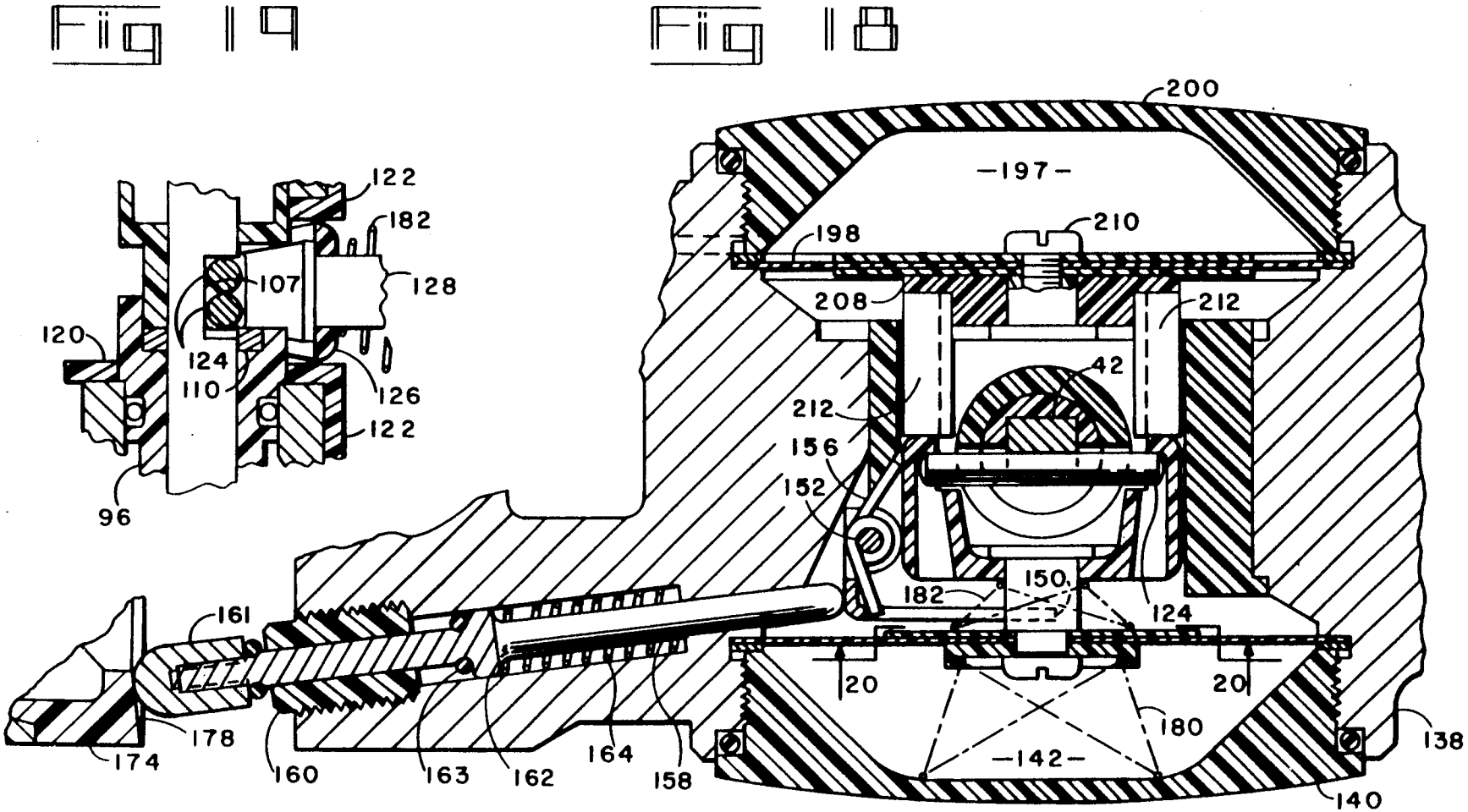

A torsion spring 156 is coiled about the pin 152 with its opposite, projecting ends respectively engaging the bridge 148 and a recessed, vertical side wall of the insert 120 to urge the trip lever in a direction tending to swing the actuator legs 150 outwardly to the position seen in FIGS. 16 and 17. It will be seen that the recess formed in the vertical side wall of the insert provides clearance for mounting the trip lever 144 and the spring 156.

It is to be appreciated that the insert 120, trip lever 144, pin 152 and spring 156 comprise a sub-assembly. The provision of these components as a sub-assembly facilitates the initial assembly of the nozzle 32 and also facilitates rebuilding of the nozzle to replace worn components, this being an accepted practice in the industry.

The angular position of the trip lever 144 is controlled by an interlock pin 158 which is slidably mounted in the body member 32 on an axis generally normal to the axis of the pin 152 and angled relative to the trip lever so that its rounded end exerts a force on the bridge 148 which is generally normal thereto. The outer end portion of the interlock pin 158 is guided in a bushing 160, with a button 161 mounted on its outer end.

Figures 3, 4, 5, 6, 7:
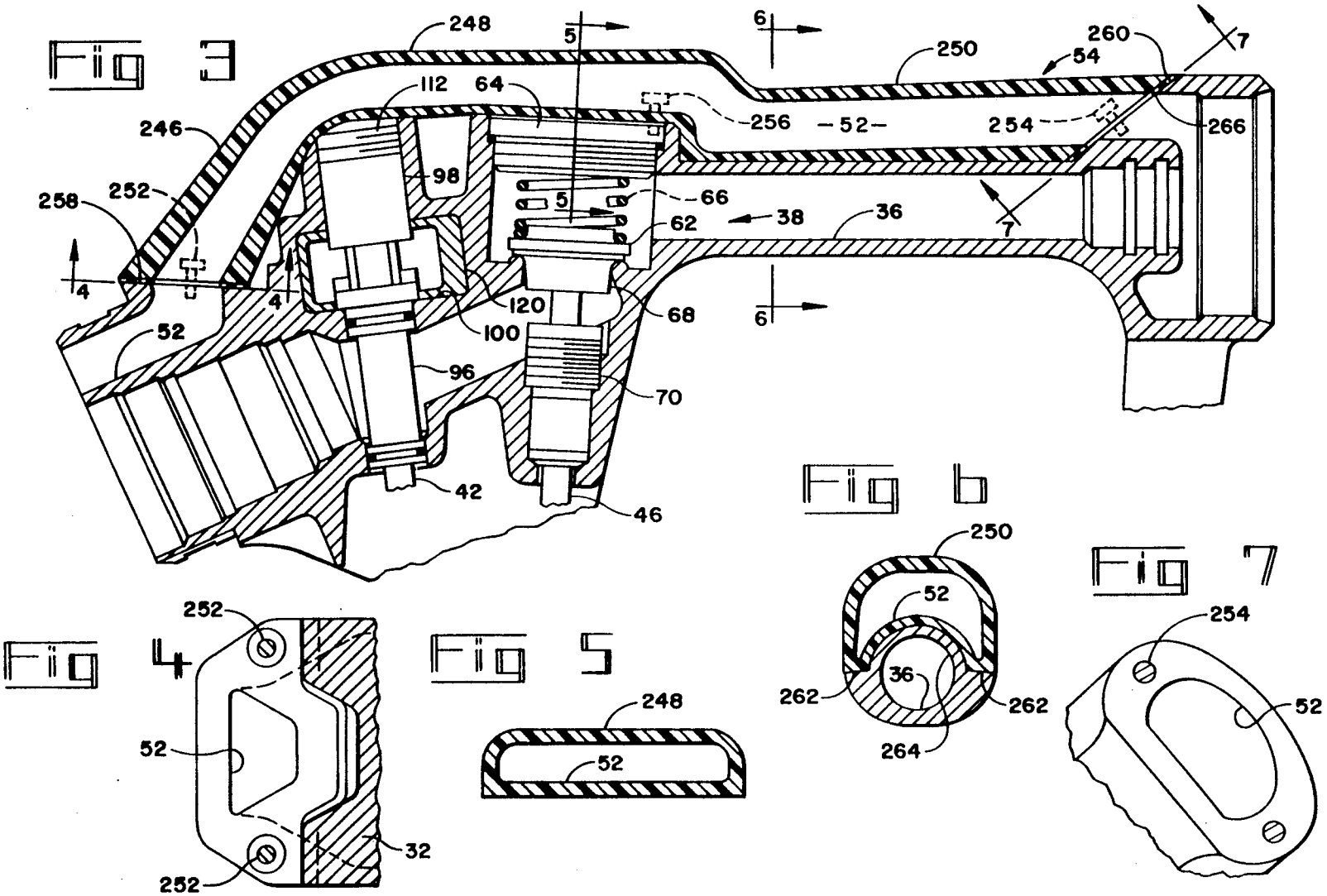
FIG. 3 is a longitudinal section, on an enlarged scale, of the body portion of the nozzle seen in FIG. 1, prior to mounting of spout and bellows sub-assemblies thereon and with the latching mechanism omitted.
FIG. 4 is a section taken on line 4—4 in FIG. 3.
FIG. 5 is a section taken on line 5—5 in FIG. 3.
FIG. 6 is a section taken on line 6—6 in FIG. 3.
FIG. 7 is a section taken on line 7—7 in FIG. 3.
Figure 4:
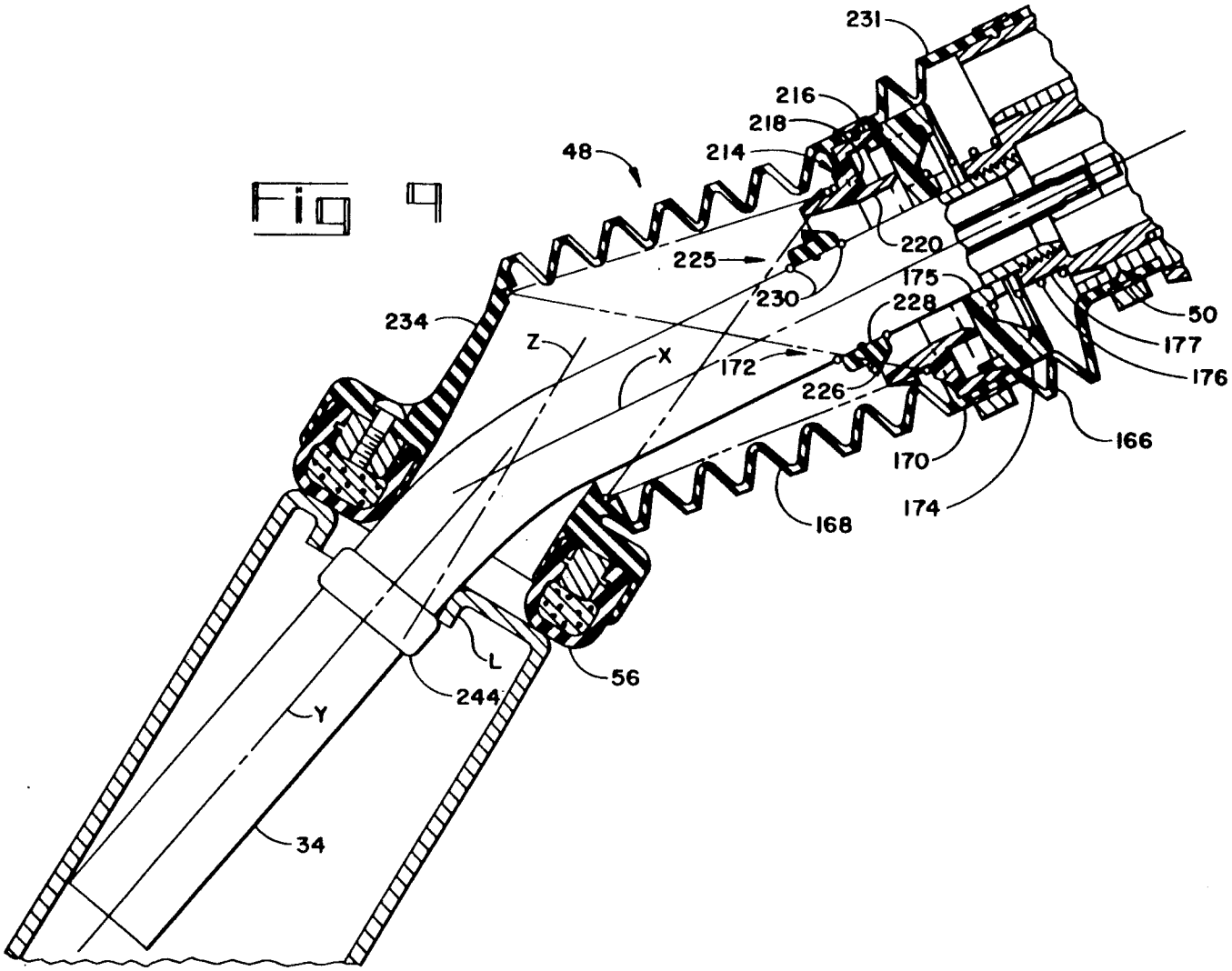

The interlock pin 158 is provided with a shoulder 162 intermediate its length which is received in a bore having a spring 164 which urges the shoulder 162 and O-ring 163, forming a seal against the bushing 160 and yieldingly maintaining the pin 158 in its rest position illustrated in FIG. 17. In this position, the torsion spring 156 pivots the trip lever 144 to a position in which the vacuum diaphragm 130 is displaced outwardly and the carrier 126 is in a position wherein the rollers are spaced outside the vertical outline of the stem 42, which is thus unlatched. It is also to be noted that the bellows is extended in this rest position, as illustrated in FIG. 3.

FIG. 9 illustrates the delivery position, or condition, of the nozzle 30. The spout 34 has been inserted and latched into the fill pipe of a vehicle fuel tank and the seal 56 brought into sealing engagement with the upper end of fill pipe. In obtaining this sealing engagement, the bellows 48 is compressed, displacing its components towards the body 31.

Figure 11:
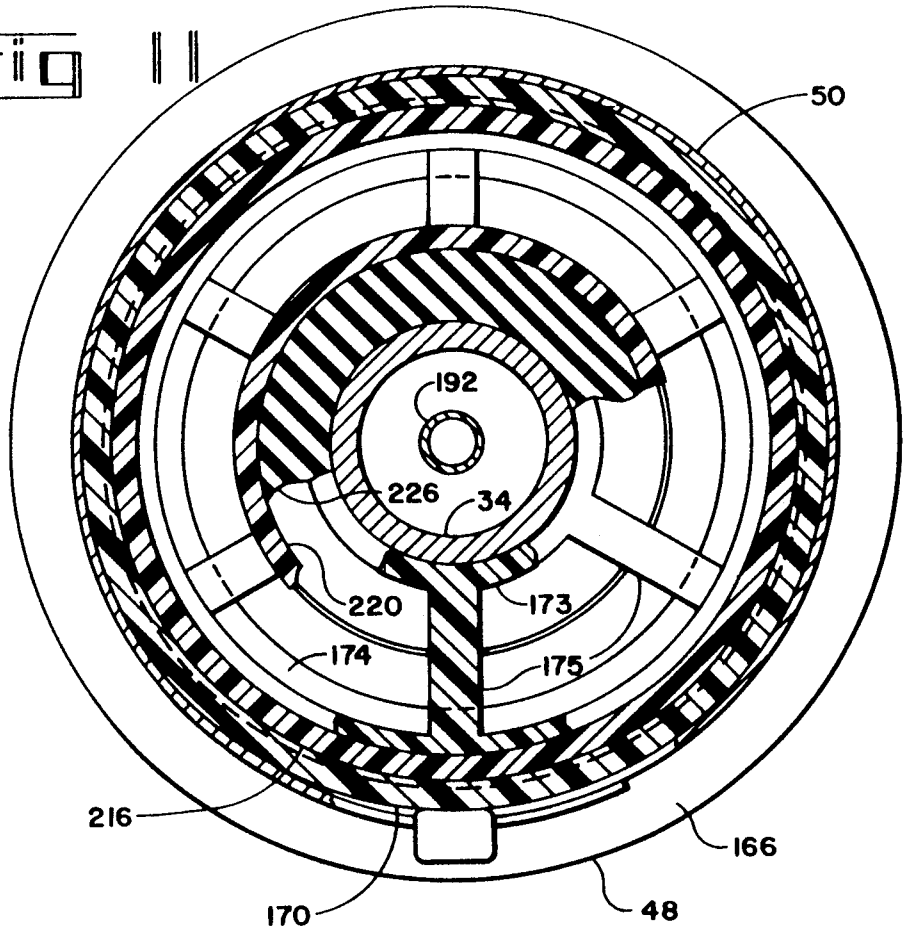
FIG. 11 is a section, on an enlarged scale, and with portions broken away, taken generally on line 11—11 in FIG. 8.
Figure 10:
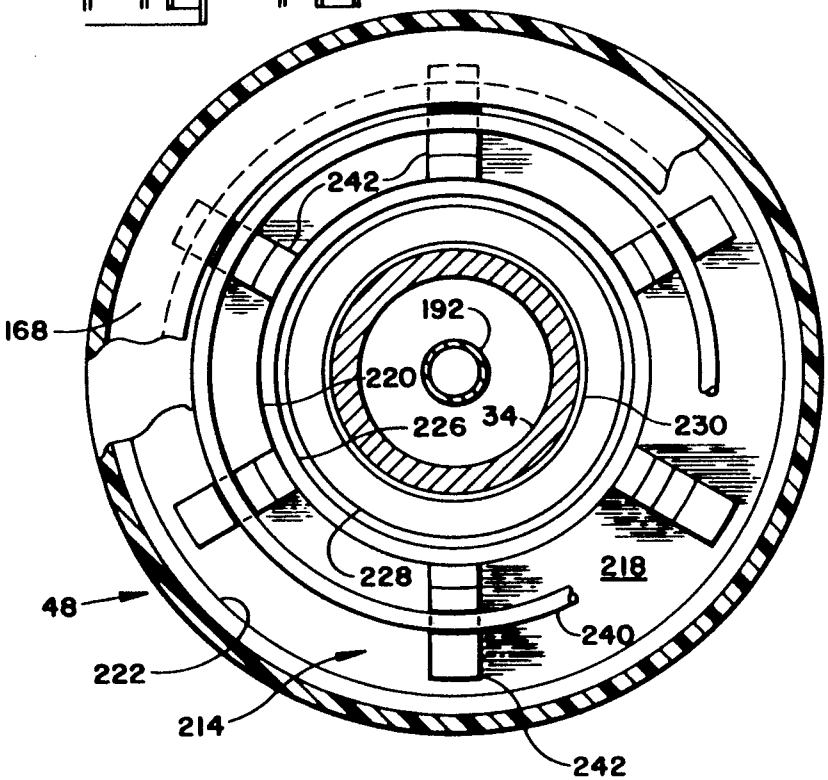
FIG. 10 is a section, on an enlarged scale, and with portions broken away, taken generally on line 10—10 in FIG. 8.

Actually, the bellows 48 comprises a convoluted inner bellows section 166 and a convoluted, outer bellows section 168 separated by a circular, tubular section 170 (FIGS. 8 and 9). A vapor valve 172 (later described in detail) is provided within the bellows 48 between the inner and outer bellows sections, 166, 168. An interlock actuator collar 174 is slidably mounted on the spout 34 by a hub 173 connected by inwardly projecting fins 175 (FIG. 11). The collar 174 is seated on the vapor valve 172 and compresses a spring 176 against a tubular adapter 177 which provides means for mounting the spout 34 on the body member 32.

When the nozzle 30 is in its delivery condition, the inner bellows section 166 is compressed to bring the actuator ring 174 to the position illustrated in FIG. 18. In being so displaced the surface 178 of actuator collar 174 engages the button 161 and the inner end of the pin 158 engages the bridge 148 to pivot the trip lever 144 to its delivery position in which the actuator legs 150 move toward the stem 42 to the position of FIG. 18. Preferably the surface 178 is normal to the axis of pin 158 so that relative movement with the button 161 will be minimized.

At this point it will be noted that a conical compression spring 180, seated on the cupped washer 136, is disposed between the cup washer 136 and the cap 140. Further a conical compression spring 182 is disposed between the diaphragm disc 134 and the roller carrier 126. The strength of the torsion spring 156 is substantially greater than the strength of the spring 180 so that the spring 180 is compressed when the trip level 144 is in its rest position.

When the trip lever 144 is swung to its delivery position, the carrier is yieldingly urged, by spring 180, towards the trip stem 42 and the rollers enter notch 107 to latch the stem 42 in its upper, operative position. The interlock remains in the described delivery position, so long as the bellows 48 is compressed to sealingly engage the fuel tank fill pipe

VACUUM SHUT OFF

As indicated above, the nozzle 30 is provided with means for automatically closing the control valve 38 when the fuel in the fill pipe reaches a given level in order to prevent spilling of fuel. In brief, these means create a vacuum in the chamber 142 which unlatches the rollers 124 from the stem notch 107.

Referencing FIG. 8, the adapter 177 is threaded onto the inner end of the spout 34. The adapter is received in a bore formed in the body member 32 and held therein by screws 184, see also FIG. 12, thereby mounting the spout 34 on the body 31. A valve seat member 186 is secured to the inner end of the adapter 177 and houses a venturi poppet 188 which is yieldingly urged against the valve seat member 186 by a spring 190 disposed within the adapter 177. The venturi poppet 188 is slidably mounted in a central hub 191 which is supported by webs extending inwardly from the adapter 177.

The tubular adapter 177 forms the downstream end of the fuel passage 36. The valve seat member 186 and poppet 188 provide a venturi valve. When the control valve 38 is opened, pressurized fuel opens the venturi valve, creating an increased flow rate at its throat. This creates a vacuum in passageways opening into the throat of the valve. These passageways are connected by other passageways, not shown, to the vacuum chamber 142 defined by the diaphragm 130 (FIG. 16). The passageways at the venturi throat are also connected by other passageways, not shown, to a vacuum tube 192 which is mounted in the adapter hub 191. The vacuum tube 192 extends interiorly of the spout 34 to a fitting 194. The fitting 194 is secured in an opening formed in the spout 34 adjacent its outer end and has a lateral passage 196 which opens exteriorly of the spout.

When the nozzle 30 is in its delivery condition (FIGS. 18 and 19) and fuel is being delivered through the spout 34, air is aspirated, through the tube 192 into the venturi valve throat and a substantially atmospheric pressure is maintained in the vacuum chamber 142. When the level of fuel in the fuel tank fill pipe rises to or above the lateral passage 196 air can no longer be freely aspirated into the tube 192. When this occurs, the venturi creates a vacuum which results in a reduced pressure in the vacuum chamber 142. Atmospheric pressure on the diaphragm 130 displaces it laterally away from the valve stem 42.

Figure 22:
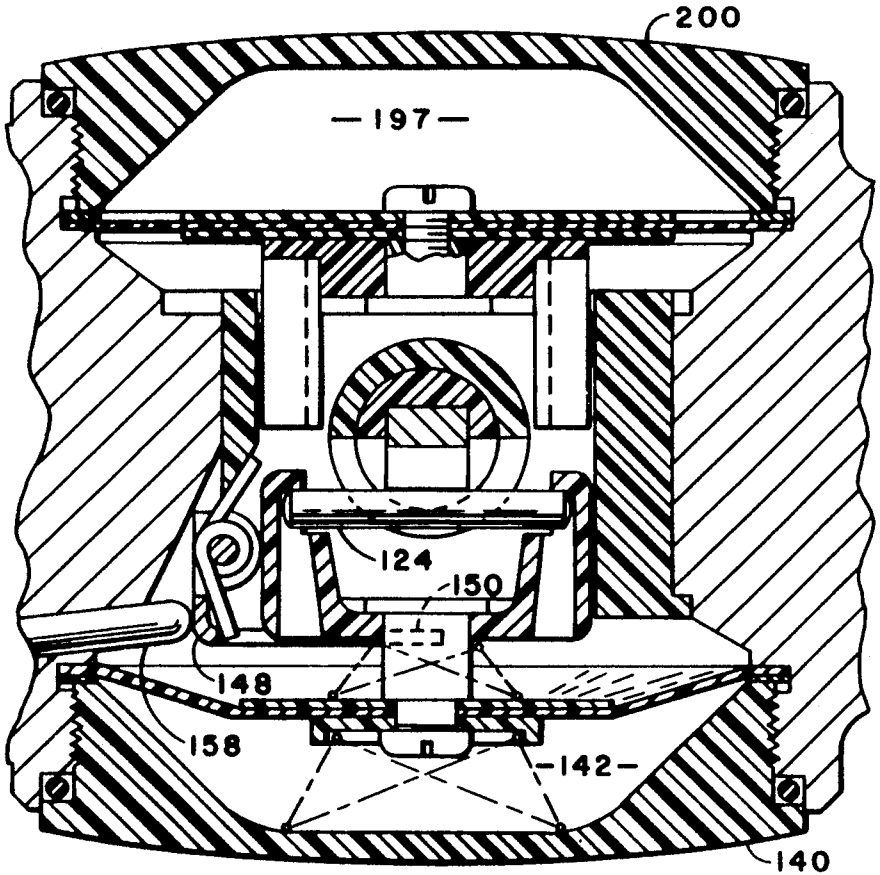
FIG. 22 is a section taken on line 17—17 in FIG. 16, illustrating actuation of the trip mechanism in response to fuel reaching a desired level in the fill pipe for a vehicle fuel tank.

This lateral displacement of the diaphragm 130 causes the head of post 128 to draw the carrier 126 away from the stem 42 and withdraw the rollers 124 from the notch 107 (FIGS. 22 and 23). The trip stem 42 is thus unlatched from its operative position and drops to the position illustrated in FIG. 15 so that the valve 38 will automatically close under the action of spring 66 (FIG. 15), as above described. After the valve 38 closes, the spring 116 returns the trip stem 42 to its operative position, illustrated in FIG. 13. It frequently occurs that splashing of fuel temporarily blocks the vent tube 192 for a time sufficient to actuate the vacuum system. If the spout 34 remains in the fill pipe, with the interlock in its delivery position, the rollers 124 automatically relatch the stem 42 in its operative position so that the lever 40 is again operative to open the valve 38 until the level of fuel in the fill pipe reaches a level which closes the vent tube and again actuates the vacuum system to unlatch the trip stem 42.

VAPOR PRESSURE SHUT OFF

As was previously indicated, flow of fuel will be shut off in the event that there is a rise in pressure in the vapor return passage, reflecting a malfunction in the vapor return system.

To this end a pressure chamber 197 (FIGS. 16 and 17) is provided by a pressure diaphragm 198 and a cap 200 threaded into a boss 202 formed on the body member 32. A friction ring 203 provides the same function as friction ring 141 in preventing undesired unthreading of the cap 200. A passageway 204 connects the pressure chamber 197 with the vapor passage 52 (see also FIG. 12), so that the pressure in the vapor passage 52 is effective on the diaphragm 198.

Discs 206 are disposed on opposite sides of the diaphragm-198 and are clamped against a pusher 208 by a screw 210 threaded into its base. The pusher has four legs 212 generally aligned with the corners of the roller carrier 126 and horizontally spaced to clear the extension 114 of the lower stem guide 96.

Figure 24:
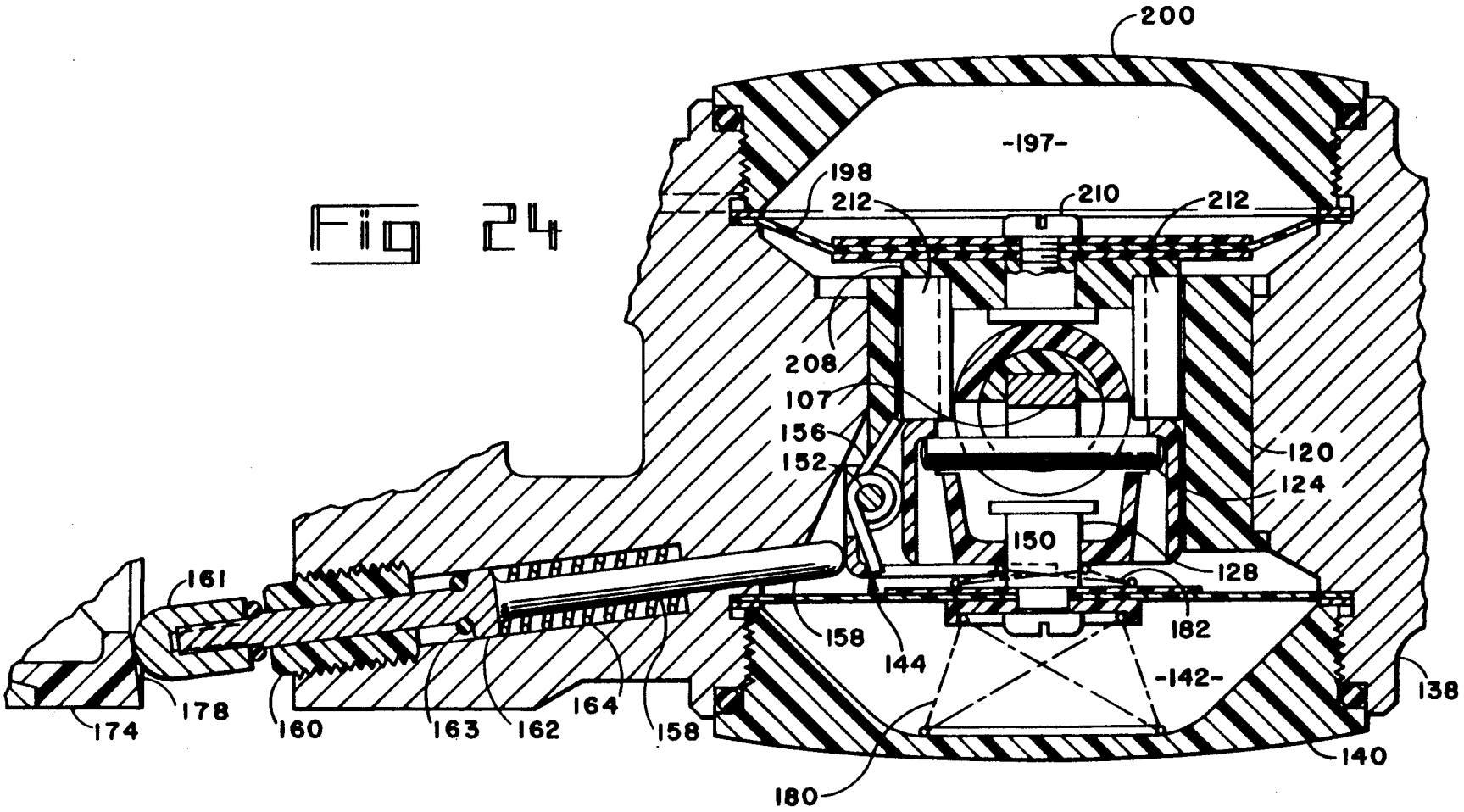
FIG. 24 is a section taken on line 17—17 in FIG. 16 illustrating the trip mechanism disengaged by an over pressure condition in the vapor return passage.

FIGS. 16 and 17 illustrate the position of pressure diaphragm when the pressure in the vapor return passage is at a normal level. FIG. 24 illustrates the diaphragm 198 displaced by a vapor return pressure which has reached a level indicating a malfunction. In the latter position, the pusher is displaced towards to the trip stem 42 and displaces the carrier 126 to a position in which the rollers 124 are withdrawn from the notch 107. It is to be noted that trip lever 144 and vacuum diaphragm remain in their delivery positions. Movement of the carrier 126 in response to movement of the pusher 208 is accommodated by a lost motion connection with the diaphragm 130, provided by the relatively weak spring 182 which permits the carrier 126 to slide on the post 128.

It will be apparent that actuation of the pressure system results in the trip stem 42 being unlatched, whereupon, it drops to the position of FIG. 15 and the valve 38 is automatically closed by the spring 66. Thereafter, spring 116 returns the stem 42 to its operative position and, if the over pressure condition has been corrected, the stem will be relatched and delivery of fuel can again be initiated by the lever 40.

VAPOR VALVE

The vapor valve 172 (FIGS. 8–11) comprises a seat sealing member 214, formed of relatively rigid material, having an outer rim 216, a radial web 218 and an inner hub having a sealing surface, or seat, 220. The seat member 214 is inserted through the inner end of the bellows 48 (before the bellows is mounted on the body 31) and telescoped into the tubular portion 170, being axially positioned by a rim 222 extending inwardly therefrom. The seat member 214 is then secured in this position by a band clamp 224. Assembly of the seat member is facilitated by the diameter of the inner hinges, or folds, of the bellows section 166 being formed on a diameter approximating the outer diameter of the rim 216.

The vapor seal 172 further comprises an annular sealing member 225 comprising a lip 226 projecting from a hub 228 which is telescoped over the spout 34. The hub 228 has an inwardly projecting bead which is positioned in a groove formed in the spout. Split retainer rings 230 are disposed in grooves in the spout 34 at opposite ends of the hub 228 to prevent movement of the sealing lip and hub on the spout. The lip 226 and hub 228 are integrally formed of resilient, rubber-like material.

The vapor seal 172 is shown in its closed position in FIG. 8, which is the rest position of the nozzle 30. As in further explained, the portion of the vapor path 52, in the body 31, opens into the annular space between the bellows 48 and the spout 34. The seal 172 prevents escape of fuel vapor from the nozzle when it is in its rest position, as it would be when hanging on a dispensing unit. More specifically, in its closed position, the lip 226 is deflected to resiliently and sealingly engage the concentric surface 220.

When the spout 34 is inserted into a fuel tank fill pipe, in the delivery condition of the nozzle 30, the valve 172 is automatically opened by compression of the inner bellows section 166, as illustrated in FIG. 9. Thus it will be seen that the sealing surface 220 has been displaced inwardly of the lip 226 to permit the flow of vapor therepast.

BELLOWS FEATURES

The bellows 48 will now be more specifically characterized (FIG. 8). In addition to the inner an outer bellows sections 166, 168 and the intermediate straight tubular section 170, the bellows also comprises a straight tubular section, or annular mounting flange, 231 at its inner end. The tubular section 231 is formed about an axis spaced above the axis for the previously described convoluted bellows sections to permit its being mounted on the body member in registration with the portion of the vapor path 52 which is formed in the body member 32. The tubular section 231 has an inwardly projecting annular bead which is received in a groove formed on the surface of the body member over which it is telescoped, thereby positioning the bellows axially of the spout 34. The bellows is secured on the body 31 by band clamp 50.

It will be noted that the inner portion of the spout 34 is formed about axis x and that the outer end portion is formed about a downwardly angled axis y with these portions being joined by a curved section. The outer, convoluted bellows section 168 is formed coaxially of axis x and extends outwardly of the intersection of the axes x and y. The outer end portion of the bellows 48 comprises a straight tubular section 234 which terminates in an integral seal holder portion 236, with the seal 56 being secured therein by screws 238. The tubular portion 234 is formed about an axis z which is angled downwardly relative to the axis y.

The bellows 48 is formed of a resilient rubber like material having an extended or rest position indicated in FIG. 8. The straight tubular portions 234, 170 and 231 are relatively rigid when subject to an axially loading upon insertion of the bellows into a fill pipe. "Compression", or shortening of the length of the bellows 48 is provided by the folds of the inner and outer convoluted bellows sections 166, 168.

Preferably the force resisting compression is provided by the spring 176 (previously described) and a spring 240 within the outer convoluted bellows section 168. The spring 240 is mounted, at one end, on fingers 242 projecting outwardly from web 218 of seat member 214, with its other end engaging a seat 243 at the outer end of the convoluted section 168. The "hinges" which connect the folds of the bellows sections 166, 168 provide a minimum resistance to rotation of the bellows folds during compression of the bellows and a shortening in the axial length of the bellows sections. Thus the sealing force exerted against a fill pipe, by the seal 56 will be provided by the spring 240 and 176. The stresses in the bellows hinges are thereby minimized to prolong the working life of the bellows.

An effective seal with the fill pipe is facilitated by certain relationships now to be described. The angle A between axes x and y is 23 deg. The preferred angle between axes x and z, in the rest position is 33 deg. Further, the end of the outer convoluted bellows section 168, in its rest position (FIG. 8), is spaced outwardly of the intersection of the axes x and y a distance which approximates the distance the end of the outer convoluted section is spaced inwardly of that intersection when the bellows in compressed in its delivery position, FIG. 9.

While the seal 56 may be manually maintained in engagement with the top of a fill pipe, it is preferred to employ abutment means which releasably lock the spout on the fill pipe, to assure that an effective sealing pressure will be obtained.

To this end, a collar 244 is secured, as by swaging, on the spout 34 spaced a predetermined distance from the outer end thereof. The spout is intended for use with a fill pipe of the type illustrated in which the outer end has surface, normal to the axis of the fill pipe, with an opening adapted to receive the spout. This opening is defined by an inturned lip l, which is engaged by the collar 244 by tilting the spout after its insertion through the opening in the end of the fill pipe.

The spout, when so locked in the fill pipe, compresses the convoluted bellows sections 166, 168 a predetermined amount. This predetermined amount can be empirically established so that actuation of the trip mechanism to latch the trip stem 42, as well as obtaining an effective seal between the bellows and the end surface of the fill pipe is assured.

VAPOR RETURN FLOW

Reference is again made to FIG. 9, which shows the nozzle in its delivery position with the outer end of the bellows 48 sealed against a fill pipe. As fuel is discharge into the tank to which the fill pipe is attached, vapors are generated and displaced from the tank as the level of fuel rises. These vapors pass upwardly through the fill pipe and are directed into the annular passage between the spout 34 and the bellows 48.

The vapors flow past the open vapor valve 172 to the inner end of the bellows 48 to enter the vapor passage 52. The vapor passage 52 is compositely formed in the body member 32 and vapor passage cap 54 (FIG. 3).

The vapor passage cap 54 generally overlies the body member 32 and includes an angled inlet portion 246 which curves to a relatively thin horizontal portion 248, overlying the trip mechanism 44 and valve 38, and a hand grip portion 250. The inlet end of the vapor passage cap 54 (at the spout end of the nozzle body 31) is secured to the body member 32 by screws 252 and the oppposite, discharge end of the cap 54 is secured to the body member 32 by screws 254. Screws 256 also secure the horizontal portion to the body member 32.

The body member 32 has a machined, horizontal surface 258 against which the nose end of the cap 54 is clamped by the screws 252, with a sealing gasket being provided therebetween. The body member 32 has a machined, angled surface 260 against which the discharge end of the cap 54 is clamped by the screws 254, with a sealing gasket being provided therebetween. The outer edge portions of inner surface of the inlet portion 246, the horizontal portion 248 and interconnecting curved portion are generally flat and engage corresponding cast surfaces on the body member 32, with their outer edges being registered.

The handle portion 250, in cross section, has a generally semi-circular outer surface and lower generally horizontal surfaces 262 with a semi-circular recess 264 therebetween. The upper surface of the underlying portion of the body member 32 has a corresponding outline and a generally semi-circular lower surface. The generally semi-circular surfaces of the handle portion 250 and the underlying portion of the body member 32 compositely form a hand grip for the nozzle which approximates the ease of use of hand grips of nozzles which do not incorporate a vapor return passage.

The vapor return passage 52, formed in the body 31, extends from an opening in the bellows end of the body member 32 to an opening in the surface 258. The passage 52 then extends through cap 54 to its angled discharge end. The cross section of the passage 52, through the cap 54 is generally uniform, with its reduced height through the horizontal portion 248 being compensated for by an increased width. Through the handle portion the passage 52 is arcuate in order to obtain the desired flow area.

The discharge end of the passage 52 is formed in the (fuel) inlet end of the body member 32, from an opening 266 to an annular chamber which registers with the vapor return hose VH. FIG. 3 illustrates the surfaces of body member 32 which are adapted to mate with mating surfaces of a known connector on which the hoses VH and FH are mounted to facilitate connection of the nozzle 30 thereto.

OTHER FEATURES

Referencing again FIG. 8, it will be seen that a groove 268 is formed in the spout 34 adjacent to and outwardly of the vapor seal hub 228. The groove 268 provides a planned failure mode in the event that a vehicle is driven away with the nozzle still inserted in its fill pipe. Should such an event occur, the spout 34 will fracture at the groove 268 so that only the tip end portion of the spout will remain with the drive away vehicle.

The force required to fracture the spout at groove 268 is relatively low so that little or no damage will be done to the remaining components of the nozzle 30, the fuel/vapor hoses and the dispensing unit to which they are attached.

The feature to be here noted is that upon the spout 34 being fractured by a drive away vehicle, the components of the vapor valve 172 remain intact and the valve will automatically close to prevent escape of fuel vapors from the vapor passage.

Other features are found in the provision of subassemblies which facilitate the original assembly of the nozzle as well as rebuilding of the nozzle to replace worn components.

One of these sub-assemblies comprises the spout 34, interlock actuator 174, spring 176, adapter 177, venturi poppet 188, spring 190, vacuum tube 192, fitting 194, vapor seal member 225, retaining rings 230 and collar 244. This sub-assembly can be readily mounted on the body member 32 and secured thereto by screws 184.

Another significant sub-assembly comprises the bellows 48, seal 56, valve seat member 214, band clamp 224 and spring 240. The mounting flange 231 of the bellows is simply telescoped over the end of the body member 32, being positioned by the bead thereon. This bellows sub-assembly is then secured in place by the band clamp 50 (FIG.). It is to be noted that in mounting the bellows sub-assembly, after the spout sub-assembly is in place, the interlocking actuator 174 seats in and against the seat member 214 to bring these components into operative relation.

Prevention of tampering is another feature of the nozzle 30. To this end, the caps 140, 200 are provided with clutch drive means in the form of notches 270 (FIGS. 1 and 2) which are engaged by a spanner wrench to thread them into the body member 32. The notches 270 are characterized by having a single wrench engaging surface which permits a torque force only in the direction which threads the caps into the body member 32. The absence of an opposite engaging surface prevents removal of the caps without leaving damage evidencing their removal.

SUMMARY OF OPERATION

In the rest condition of the nozzle 30 the control valve 38 is in its closed position and the trip stem 42 is in its upper, operative position, but is unlatched so that the control cannot be opened by the lever 40 (FIG. 13). The bellows 48 is in its extended position, thereby leaving the interlock trip mechanism inoperative to latch the trip stem 42. Also the vapor valve 172 is closed (FIG. 8).

In the delivery position of the nozzle 30, the spout 34 is properly inserted in a fill pipe (FIG. 9). The trip lever 144 is pivoted, by the interlock pin 158, allowing the spring loaded carrier 126 to engage the rollers 124 in notch 107 to latch the trip stem 42 in its operative position (FIGS. 18 and 19). The lever 40 may be raised to open the valve 38 (FIG. 14) for the delivery of fuel through passage 36 and spout 34 into a fill pipe. Fuel vapor returns from fill pipe, through the bellows 48, vapor valve 172 now being open, through the vapor passage 52, to the vapor return hose VH.

If the level of fuel in the fill pipe covers the spout entrance to the vacuum tube 192, a negative pressure is created in the vacuum chamber 142. This results in disengagement of the rollers 124 from notch 107 (FIGS. 22 and 23). The trip stem 42 is unlatched and drops to the position of FIG. 15, thereby causing the control valve 38 to close.

If their is a blockage in the return flow of vapors to the fuel storage tank, a pressure rise in pressure chamber 197 causes the pusher 208 to disengage the rollers 124 from the notch 107 (FIG. 24). The trip stem 42 is thus unlatched from its operative position and the valve 38 closed (FIG. 15).

If the spout 34 becomes disengaged from the fill pipe, the bellows 48 assumes an extended position. The interlock stem 158 permits the trip lever 144 to swing outwardly to disengage the rollers 124 from notch 107 and unlatch the trip stem 42. Once the trip stem is unlatched, the valve 38 automatically closes.

It will be briefly noted that the selection of materials for the various components of the nozzle 30 would be within the abilities of one skilled in the art, given the functions and purposes herein described. For example, various materials are recognized as being compatible with and not subject to degradation by petroleum based fuels. Also, many components can be formed of so-called plastics, or resinous materials, which give adequate strength and rigidity, or resiliency, for a specific component function.

Variations from the described, preferred embodiment will occur to those skilled in the art within the spirit and scope of the invention as set forth in the following claims.

Having thus described the invention, what is claimed as novel and desired to be secured by Letters Patent of the United States is :

1. A vapor recovery nozzle comprising a body having a fuel passage and a vapor passage, a spout, in flow communication with the fuel passage, projecting from one end of the body, a bellows, in flow communication with said vapor passage, with an inner end of the bellows mounted on said one end of the body and defining a vapor flow path around said spout, said bellows being extended in a rest position of the nozzle, a normally closed control valve interposed in said fuel passage, a trip stem slidable to and from an operative position, lever means connected to the trip stem and effective to open the control valve, to maintain it open, only when the trip stem is latched in its operative position, means, engageable with said trip stem, for latching it in its operative position, said latching means being disengaged from the trip stem in the rest position of the nozzle, said nozzle having a delivery position in which the spout is inserted into a fuel tank fill pipe and the bellows is compressed and an outer end of the bellows sealingly engages the outer end of the fill pipe, mechanical interlock means, operative when the control is in both its open and closed positions, for preventing engagement of the latch means with the trip stem in the rest position of the nozzle, when the bellows is extended from its compressed condition in the nozzle's delivery position, resilient means for urging the latching means toward engagement with the trip stem, said mechanical interlock means, being responsive to compression of the bellows in the delivery position of the nozzle, to permit and resilient means to engage the latch means with the trip stem to latch it in its operative position, and further including a vapor valve, disposed within the bellows, for controlling vapor flow through said vapor flow path, said vapor valve comprising an annular member secured to the bellows, said vapor valve being closed in the rest position of the nozzle and open in the delivery position of the nozzle, characterized in that the interlock means comprise a pin slidably mounted on the body and disposed generally parallel to the inner end portion of the bellows, and an actuator collar, separate from said pin, mounted within said bellows, said actuator collar being movable in fixed relation with said bellows as it is compressed and being engageable with said pin, said collar, in the compressed delivery position of said bellows, displacing said pin to permit the resilient means to engage the latching means with the trip stem, thereby latching the trip stem in its operative position, and further wherein said actuator collar moves with said vapor valve member when the bellows is compressed to a delivery position.

2. A vapor recovery nozzle as in claim 1 wherein the bellows has a relatively short, inner convoluted section adjacent the nozzle body, an outer, relatively long convoluted section, and a non-convoluted section between the convoluted sections, said vapor valve member is mounted within said non-convoluted section, said actuator collar engages the side of said vapor valve member facing the nozzle body, and a compression spring is disposed between the actuator collar and the nozzle body.

3. A vapor recovery nozzle comprising a body having a fuel passage and a vapor passage, a spout, in flow communication with the fuel passage, projecting from one end of the body, a bellows, in flow communication with said vapor passage, mounted on said one end of the body and difining a vapor flow path around said spout, said bellows being extended in a rest position of the nozzle, a normally closed control valve interposed in said fuel passage, a trip stem slidable to and from an operative position, lever means connected to the trip stem and effective to open the control valve, to maintain it open, only when the trip stem is latched in its operative position, means, engageable with said trip stem, for latching it in its operative position, said latching means being disengaged from the trip stem in the rest position of the nozzle, said nozzle having a delivery position in which the spout is inserted into a fuel tank fill pipe and the bellows is compressed and sealingly engages the outer end of the fill pipe, vacuum actuated means, operative in the delivery position of the nozzle and when the control valve is open, for generating a vacuum and disengaging the latch means from the trip stem in response to the liquid in the fill pipe exceeding a given level, said vacuum actuated means comprising a vacuum diaphragm, mechanical interlock means, operative when the control is in both its open and closed positions, for preventing engagement of the latch means with the trip stem in the rest position of the nozzle, when the bellows is extended from its compressed condition in the nozzle's delivery position, resilient means for urging the latching means toward engagement with the trip stem, said resilient means urging the latching means toward engagement with the trip stem being mounted on the vacuum diaphragm, said mechanical interlock means, being responsive to compression of the bellows in the delivery position of the nozzle, to permit said resilient means to engage the latch means with the trip stem to latch it in its operative position, and characterized in that the latch means are connected to the vacuum actuated means, and the interlock means include means acting on the vacuum actuated means, independently of the generation of a vacuum, to disengage the latch means in the rest position of the nozzle, and said interlock means comprising an interlock member which contacts said vacuum diaphragm.

4. A vapor recovery nozzle as in claim 3 wherein the trip stem has a notch formed along the length thereof, the latching means comprise roller means adapted to enter said notch to engage the trip stem and lock it in its operative position, a carrier on which the roller means are mounted, said carrier being mounted on said vacuum diaphragm, and said resilient means comprise diaphragm spring means, acting on one side of said vacuum diaphragm, urging said carrier and roller means toward said stem.

5. A vapor recovery nozzle as in claim 4 wherein the stem is generally vertically disposed, movement of the roller means and carrier is in a horizontal plane, the interlock member engaging the vacuum diaphragm is a trip lever pivotally mounted about a vertical axis, and the interlock means further comprise a pin slidably mounted on the body and disposed generally parallel to the inner end portion of the bellows, said pin being engagable with said trip lever, and an actuator collar mounted within said bellows, engageable with said pin, said collar, in the compressed delivery position of said bellows, displacing said pin to pivot said trip lever and permit the resilient means to engage the latching means with the trip stem, thereby latching the trip stem in its operative position.

6. A vapor recovery nozzle as in claim 5 wherein the axes of the vapor passage, the fuel passage, the spout and the trip stem are generally disposed in a vertical, longitudinal plane, the vacuum diaphragm has a circular outline and is disposed in a vertical plane outwardly spaced from said longitudinal plane, a mounting pin is provided for mounting said trip lever, the interlock trip lever has an inner leg extending outwardly from said mounting pin and an outer leg at right angles thereto and extending between said carrier and said vacuum diaphragm, and said interlock pin is engageable with said trip lever at the juncture of its inner and outer legs.

7. A vapor recovery nozzle as in claim 6 wherein the nozzle body has a lateral passageway in which the diaphragm, the outer end of the trip lever, said carrier, and said roller means are disposed in series relationship, a vacuum cap, threaded into said body, defines, in combination with the outer surface of the vacuum diaphragm, a vacuum chamber, the diaphragm spring is disposed between said vacuum diaphragm and said cap, a relatively rigid disc is disposed on the inner surface of said vacuum diaphragm, and the outer trip lever leg is bifurcated to provide clearance for said carrier to pass therebetween and engages said relatively rigid disc.

8. A vapor recovery nozzle as in claim 7 further comprising a torsion spring, coiled about the trip lever pivot pin, urges the bifurcated outer leg of the trip lever to compress the vacuum diaphragm spring and maintain the latching roller means out of engagement with the stem notch in the rest position of the nozzle.

9. a vapor recover nozzle as in claim 8 further comprising a vapor valve, disposed within the bellows, for controlling vapor flow through said vapor flow path, said vapor valve comprising an annular member mounted on the bellows, said vapor valve being closed in the rest position of the nozzle and open in the delivery position of the nozzle, and wherein said actuator collar moves with said vapor valve member when the bellows is compressed to a delivery position, and further comprising spring means for maintaining the interlock pin in a position wherein the trip lever disengages the latching means, when the nozzle is in its rest position.

10. A vapor recovery nozzle as in claim 9 wherein the axis of the interlock pin angles inwardly from the inner end of the nozzle body towards the trip lever, and a button is provided on an end of the interlock pin extending beyond the nozzle body, and the surface of the actuator collar is normal to the axis of the interlock pin.

11. A vapor recovery nozzle as in claim 7 further comprising a pressure diaphragm disposed in the lateral passageway of said nozzle body, said pressure diaphragm being disposed parallel to the vacuum diaphragm and spaced from said trip stem on the opposite side thereof, a pressure cap threaded into said passageway and defining, in combination with the outer surface or said pressure diaphragm, a pressure chamber, a pusher member mounted on the inner surface of said pressure diaphragm, said pusher member having legs engageable with the carrier for the roller means, and passage means connecting said vapor passage and said pressure chamber, whereby the roller means are disengaged from the trip stem notch when the pressure in the vapor passage exceeds a predetermined level.

12. A vapor recovery nozzle as in claim 11 wherein the carrier for the roller means is slidably mounted on a post extending inwardly from the vacuum diaphragm, a carrier spring is disposed between the carrier and the vacuum diaphragm, to resiliently maintain the roller means in latching engagement with the trip stem notch.

13. A vapor recovery nozzle as in claim 12 wherein the trip stem has a square cross section, a lower stem guide is mounted in the nozzle body below said lateral passageway and has an upper extension extending into said passageway on the side of said trip stem opposite said notch, an upper stem guide mounted in the nozzle body above said passageway and having an extension projecting into said lateral aperture on the side of said trip stem opposite to said notch.

14. A vapor recovery nozzle as in claim 13 wherein the central portion of the lateral passage has a generally rectangular cross section, and further comprising a tubular insert having an outer outline received in said passageway and inner outline defining an opening which receives the roller means, the roller carrier and the pressure diaphragm pusher, the top and bottom walls of the insert having apertures through which the trip stem extends, said insert having tabs on which the trip lever pin is mounted and between which the trip lever is disposed at one end of the insert.

15. A vapor recovery nozzle as in claim 14 wherein said insert tabs are formed as extensions of the upper and lower walls of the insert, an opening in the side wall adjacent said tabs extends inwardly from the tabs, the inner leg of the trip lever is bifurcated with these bifurcated portions being pivotally mounted on said trip lever pin, a torsion spring is coiled about the trip lever pin, between the bifurcated portions of the inner leg with extensions from opposite ends thereof respectively engaging the inner end of the side wall opening and the trip lever.

16. A vapor recovery nozzle as in claim 15 wherein said nozzle body has a counter bore facing the vacuum diaphragm, coaxially of the lateral passageway, and the insert has a circular flange, at the end from which said tabs project, said flange being received in said counter bore.

17. A vapor recovery nozzle comprising a body having a fuel passage and a vapor passage, a spout, in flow communication with the fuel passage, projecting from one end of the body, a bellows, in flow communication with said vapor passage, mounted on said one end of the body and defining a vapor flow path around said spout, said bellows being extended in a rest position of the nozzle, a normally closed control valve interposed in said fuel passage, a trip stem slidable to and from an operative position, lever means connected to the trip stem and effective to open the control valve, to maintain it open, only when the trip stem is latched in its operative position, means, engageable with said trip stem, for latching it in its operative position, said latching means being disengaged from the trip stem in the rest position of the nozzle, said nozzle having a delivery position in which the spout is inserted into a fuel tank fill pipe and the bellows is compressed and sealingly engages the outer end of the fill pipe, vacuum actuated means, operative in the delivery position of the nozzle and when the control valve is open, for generating a vacuum and disengaging the latch means from the trip stem in response to the liquid in the fill pipe exceeding a given level, and mechanical interlock means, operative when the control is in both its open and closed positions, for preventing engagement of the latch means with the trip stem in the rest position of the nozzle, when the bellows is extended from its compressed condition in the nozzle's delivery position, resilient means for urging the latching means toward engagement with the trip stem, said mechanical interlock means, being responsive to compression of the bellows in the delivery position of the nozzle, to permit said resilient means to engage the latch means with the trip stem to latch it in its operative position, and characterized in that the latch means are connected to the vacuum actuated means, the interlock means include means which contacts the vacuum actuated means, independently of the generation of a vacuum, to disengage the latch means in the rest position of the nozzle, and the nozzle further comprises pressure means, independent of the mechanical interlock means, responsive to a predetermined pressure in said vapor passage, for disengaging the latching means.

18. A vapor recovery nozzle comprising a body having a fuel passage and a vapor passage, a spout, in flow communication with the fuel passage, projecting from one end of the body, a bellows, in flow communication with said vapor passage, mounted on said one end of the body and defining a vapor flow path around said spout, said bellows being extended in a rest position of the nozzle, a normally closed control valve interposed in said fuel passage, means for opening said valve to discharge fuel from said spout, said nozzle having a delivery position in which the spout is inserted into a fuel tank fill pipe and the bellows is compressed and sealingly engages the outer end of the fill pipe, and a vapor valve, disposed within said bellows, for controlling flow of vapor within the bellows, said vapor valve being closed in the rest position of the nozzle and open when the bellows in compressed to its delivery position, said vapor valve comprising a first sealing member, and a second sealing member one of said sealing members being mounted on the bellows and the other of said sealing members being mounted on the spout, said bellows having a relatively short, inner convoluted section adjacent the nozzle body, an outer, relatively long convoluted section, and a non-convoluted section between the convoluted sections, and said first vapor valve sealing member being mounted in said non-convoluted bellows section, said nozzle further comprising interlock means for preventing opening of said control valve until the bellows is compressed in its delivery position, said interlock means comprising means mounted on said nozzle body, and characterized by an actuator collar disposed in the inner convoluted bellows section between said first vapor seal member and said nozzle body, said collar being connectable to said nozzle body mounted interlock means, and a compression spring disposed within the inner convoluted bellows section, between said collar and the adjacent inner end of the nozzle body.

19. A vapor recovery nozzle as in claim 18 further comprising an adapter to which the spout is attached, a venturi valve mounted in said adapter, said body having a bore receiving said adapter, said interlock collar having a hub, connected thereto by inwardly projecting legs, guiding it for sliding movement on said spout, and wherein the compression spring in the inner convoluted section is disposed between and engages the collar legs and the adapter and urges the interlock collar into engagement with the rim of the first vapor valve member, and means are provided for releasably retaining said adapter in the bore in said body.

* * * * *